US005190303A

United States Patent [19]

Schumacher et al.

[11] Patent Number: 5,190,303

[45] Date of Patent: Mar. 2, 1993

[54] MOBILE WORK STATION FOR PAINTER

[75] Inventors: Kevin H. Schumacher, Baltimore; Robert J. Martin; Edward L. Martin, both of Hampstead, all of Md.

[73] Assignee: Leonard Bloom, Towson, Md.

[21] Appl. No.: 873,700

[22] Filed: Apr. 22, 1992

Related U.S. Application Data

[63] Continuation of Ser. No. 532,388, Jun. 7, 1990, abandoned, which is a continuation-in-part of Ser. No. 371,032, Jun. 26, 1989, Pat. No. 4,993,726.

[51] Int. Cl.[5] ..... B62B 3/00

[52] U.S. Cl. ..... 280/38; 108/14; 108/25; 108/129; 280/47.35; 312/293.3

[58] Field of Search ..... 15/257.06; 296/22; 108/13, 14, 157, 125, 129, 25, 26; 248/129; 206/557; 312/293.3; 280/35, 38, 651, 47.34, 47.35, 79.2, 79.5

[56] References Cited

U.S. PATENT DOCUMENTS

| | | | |
|---|---|---|---|
| 253,024 | 1/1882 | Ertell | 280/79.11 X |
| D. 302,618 | 8/1989 | Gottselig | D34/17 |
| 2,319,589 | 5/1943 | Drinkwater | 280/47.35 |
| 2,520,543 | 8/1950 | Hawkins | 296/22 X |
| 2,603,500 | 7/1952 | Messier | 296/22 X |
| 2,672,391 | 3/1954 | Moore | 280/30 X |
| 2,779,960 | 2/1957 | Ogren | 15/257.06 |
| 2,969,830 | 1/1961 | Thompson | 297/130 X |
| 3,162,462 | 12/1964 | Elders | 280/79.2 X |
| 3,602,939 | 9/1971 | Schoenholz | 15/257.06 |
| 3,822,846 | 7/1974 | Jesionowski | 248/210 |
| 4,094,431 | 6/1978 | Wheeler | 15/257.06 X |
| 4,325,323 | 4/1982 | Rioux | 280/35 X |
| 4,547,926 | 10/1985 | Kern | 15/257.06 |
| 4,669,609 | 6/1987 | Lugo | 15/257.06 X |
| 5,002,293 | 3/1991 | Gottselig | 280/47.35 |
| 5,004,255 | 4/1991 | Briggs | 280/79.5 |

FOREIGN PATENT DOCUMENTS

| | | | |
|---|---|---|---|
| 677173 | 3/1958 | France | 15/257.06 |
| 613674 | 12/1948 | United Kingdom | 296/22 |

*Primary Examiner*—Margaret A. Focarino
*Assistant Examiner*—Michael Mar
*Attorney, Agent, or Firm*—Leonard Bloom

[57] ABSTRACT

A mobile work station for a painter or the like includes a frame and further includes a tray to hold paint containers (such as a paint pan) as well as tools, accessories and the painter's personal items. The tray may be segmented or divided into compartments for the paint pan and various articles. Legs are pivotally mounted on the frame for ease of storage and transport, and the legs have stored and depending positions, respectively. A removable cover is provided for the tray; and the cover may be disposed between the legs to further support the legs and to serve as a shelf during use of the mobile work station.

20 Claims, 16 Drawing Sheets

MOBILE WORK STATION FOR PAINTER

CROSS-REFERENCE TO RELATED APPLICATION

This application is a continuation of application Ser. No. 07/532,388, filed Jun. 7, 1990, now abandoned, which is a continuation-in-part of co-pending application Ser. No. 371,032 filed on Jun. 26, 1989, now U.S. Pat. No. 4,993,726 the disclosure of which is incorporated by reference herein in its entirety.

BACKGROUND OF THE INVENTION

In the process of painting, the painter places the container of paint on a surface and dips the brush or paint roller into the container. The container may be a paint can whenever a brush is used, and a pan whenever a roller is used by the painter.

Since the container is bulky and prone to spilling, thereby causing damage and requiring much time wasted in clean up, the paint container is moved infrequently. This necessitates constant travel by the painter from the work area to the paint container, which is tiring and inefficient. Also, the paint container is usually placed on the floor increasing the possibility of spillage and other accidents. This location is inconvenient for the painter who must bend over to apply paint to the roller.

When brushing, the painter holds a paint can in one hand and paints with the brush in the other hand. This has the obvious disadvantages of restricting the painter's movement besides being tiring and inefficient, since a relatively small amount of paint may be held in the paint can.

Furthermore, the painter's accessory tools and equipment (sandpaper, wipes, tape, spackle, etc.) and personal items (beverage, cigarettes, ash tray, etc.) are not located near the work area; and thus the painter must leave the work area to get these items. Again, this is time consuming and inefficient.

Accordingly, it will be appreciated that painting is often an unpleasant task for a "do-it yourself" homeowner (and even for a professional painter) because the overall arrangement is inefficient; and thus a need exists for a mobile work station to improve efficiency and make painting more convenient and less tiring and time consuming.

The only prior art of which the applicant is aware—which is directed to a movable paint stand—is Wahl U.S. Letters Pat. No. 2,580,623 issued on Jan. 1, 1952 in which there is disclosed a stand to support a paint pail, the stand being mounted on a carriage having rollers. The paint stand may not be folded for ease of transport or storage, it does not accommodate a paint pan for use with a paint roller and it has no provisions to accommodate tools, accessories or personal items.

Additionally, Renschin U.S. Letters Pat. No. 2,290,450 issued on Jul. 21,1942 discloses a telescoping tube to support a horizontal rod. The rod takes the place of a man in holding paper to be applied to a ceiling so that a single person can perform the papering. The horizontal rod can be replaced by a pan to hold a bucket of paint to facilitate dipping a brush in the paint when painting a ceiling. The device is not mobile and may not be folded for use of transport or storage.

The applicant is also aware of the following prior patents:

| Inventor(s) | U.S. Pat. No. |
|---|---|
| Clark | 1,901,732 |
| Conger | 2,284,801 |
| Hotton | 2,981,549 |
| Shackel | 3,170,709 |
| DeVitt et al | 3,181,483 |
| Burns | 3,220,773 |
| Swick, Jr. | 3,759,599 |
| Hines | 4,119,044 |
| Schreiner | 4,363,496 |
| Remington et al | 4,535,897 |
| Teachout | 4,537,421 |
| Cunningham | 4,679,805 |
| Betts et al | 4,690,417 |
| Liegel | 4,715,573 |
| Coote | 4,728,065 |
| Kirkendall | 4,796,909 |
| Grow | D 183,425 |
| Corini | D 230,257 |
| Salsgiver | D 232,166 |
| Daventry | D 271,733 |
| Luyk et al | D 289,459 |
| Bettress | D 296,143. |

As would be expected, these patents disclose a wide variety of movable carts and tool stands for various purposes. However, there is no disclosure nor teaching that these carts may be used for, nor readily adapted to, the unique requirements of a painter. A painter should have ready and convenient access to the paint, to the brushes, roller and other painting accessories, and to the personal items of the painter.

To the best of our knowledge and belief, there is no commercial product on the market, which provides a mobile, versatile, articulatable, portable work station for a painter.

Accordingly, it will be readily appreciated that there exists a longstanding and critical need for a mobile work station for use specifically by painters, wherein the mobile work station has the following features and advantages: it may be moved easily and conveniently to the immediate work area; it holds the paint container (such as a pan) so that the paint is less liable to be spilled; it holds the paint pan at a convenient height, so that the painter does less bending; it holds the necessary tools, accessories and personal items; and it may be folded for ease of storage and transport.

SUMMARY OF THE INVENTION

Accordingly, it is a principal object of the present invention to alleviate the deficiencies and disadvantages of the prior art by providing a painter's mobile work station which holds a paint container (such as a pan) as well as tools, accessories and personal items, and which may be conveniently moved about on the job.

It is another object of the present invention to provide a painter's mobile work station which improves efficiency, reduces travel of the painter between the work area and the paint container, and is less time consuming and tiring for the painter.

It is yet another object of the present invention to provide a mobile work station which holds the paint at a convenient height, so as to be less tiring to the painter.

It is a further object of the present invention to provide a mobile work station which is compact and relatively lightweight, may be easily stored, and may be carried to the job site.

It is still a further object of the present invention to eliminate the placement of the paint container on the floor, thereby decreasing the possibility of spillage and accidents such as kicking or stepping into the paint container.

It is additional object of the present invention to enable the painter to use a larger, deeper paint pan which holds a greater quantity of paint thereby reducing the number of times the painter must interrupt his work to refill the paint pan.

It is still a further object of the present invention to provide a paint pan having two shallower ends and a deeper center portion thereby permitting the painter to use a paint roller when the painter is positioned at either end of the paint pan.

Yet a further object of the present invention is to enable the painter to place a five gallon bucket of paint into an open well on the device which facilitates using a paint roller with a larger bucket as opposed to a paint pan.

In accordance with the teachings of the present invention, there is disclosed a mobile work station for a painter or the like, wherein the work station is relatively lightweight and collapsible to facilitate transport and storage. The mobile work station includes a substantially rectangular frame having four side walls. The side walls form an open well substantially in the center of the frame. A tray having side walls and a bottom is provided; and the tray is mounted in the open well in the frame; such that a paint roller, paint pan, brushes and the like may be disposed in the tray, and such that the work station may be moved about by the painter on the job. The mobile work station further has four legs, each of which has a first end and a second end. The first end of each leg is mounted on the frame and is capable of being pivoted, such that each leg has a first position in which the leg is adjacent to (or nested within) the frame, and such that each leg has a second position in which the leg depends downwardly to support the frame. Means are provided for securing each leg in both the first and second positions; and casters are carried by the second end of each leg, thereby facilitating the convenient movement of the mobile work station on the job. A cover is removably attached to the frame and, when so attached, encloses the open well in the frame. In this manner, the tray and the contents of the tray are contained in the frame during storage and transport of the mobile work station. When the cover is detached from the frame, the cover may be disposed between the legs (when the legs are in their second downwardly-depending position) thereby further supporting the legs and providing additional structural integrity for the mobile work station. Additionally, the cover may serve as a shelf during use of the mobile work station. The work station is further provided with a suitable handle means connected to the frame to facilitate movement of the mobile work station by the painter on the job.

Viewed in another aspect, the present invention provides a mobile work station for a painter, wherein the mobile work station is compact, lightweight and readily portable, and wherein the mobile work station may be quickly set up on the job and, thereafter, may be quickly folded up for convenient storage. The mobile work station includes a frame having a plurality of legs and, preferably, the legs have respective wheel means thereon. Means are provided for folding the legs into a compact storage position on the frame, and means are further provided for extending the legs into a downwardly-depending operative position relative to the frame. The frame has an open well formed thereon, and means are provided for supporting a removable paint pan on the frame during use of the mobile work station. When the mobile work station is not in use, a removable cover is provided for the open well in the frame. When the mobile work station is in use, however, the cover may be disposed between the downwardly-depending legs and removably secured thereto, thereby providing additional structural integrity for the mobile work station during use thereof. In this position, the cover also forms a shelf, and (with the paint pan removed from the frame) a relatively large paint can may be received down through the open well in the frame and supported by the shelf.

Preferably, the means to support the paint pan on the frame comprises a tray removably received in the open well in the frame. The tray has a plurality of laterally-extending flanges supported on the frame; and the tray is segmented to provide a first recess for the paint pan and at least a second recess for tools, accessories, and/or the painter's personal items.

A handle is carried on the frame to facilitate movement of the mobile work station by the painter. The paint pan has a shallow end and a deeper end, respectively; and preferably, the first recess in the tray is configured to assure that the shallow end of the paint pan is disposed towards the handle, and the deeper end of the paint pan is disposed away from the handle, whenever the paint pan is in the first recess in the tray.

Still other objects of the present invention will become readily apparent to those skilled in this art from the following description, wherein there is shown and described a preferred embodiment of this invention. Simply by way of illustration, the invention will be set forth in part in the description that follows and in part will become apparent to those skilled in the art upon examination of the following or may be learned with the practice of the invention. Accordingly, the drawings and descriptions will be regarded as illustrative in nature and not as restrictive.

BRIEF DESCRIPTION OF THE PREFERRED EMBODIMENTS

Figure 2:
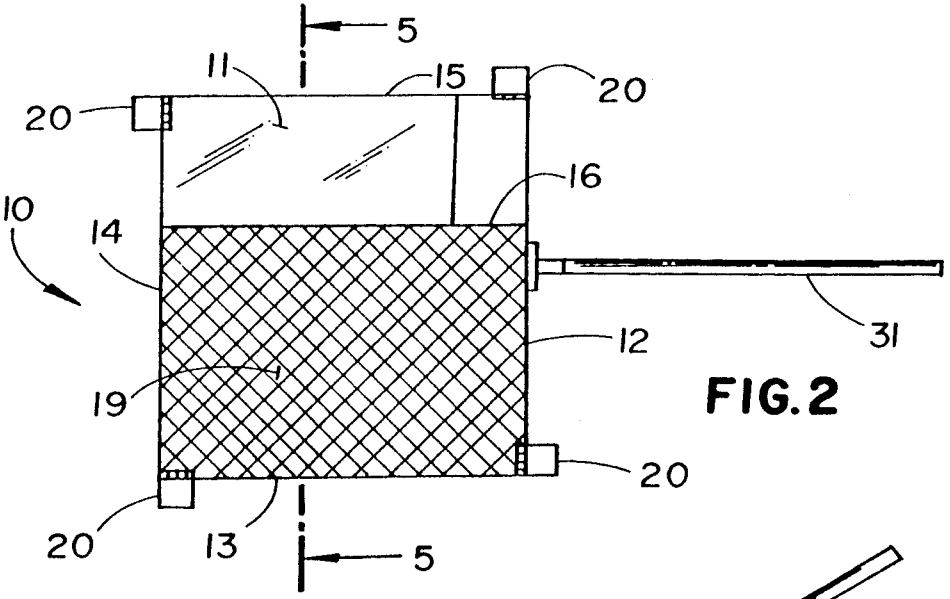
FIG. 2 is a top plan view thereof.
Figure 4:
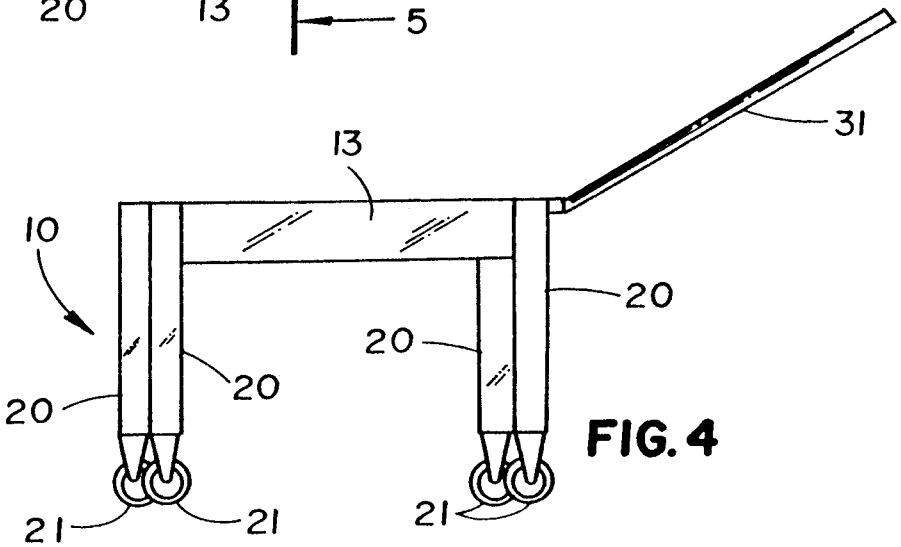
FIG. 4 is a side view thereof.
Figure 1:
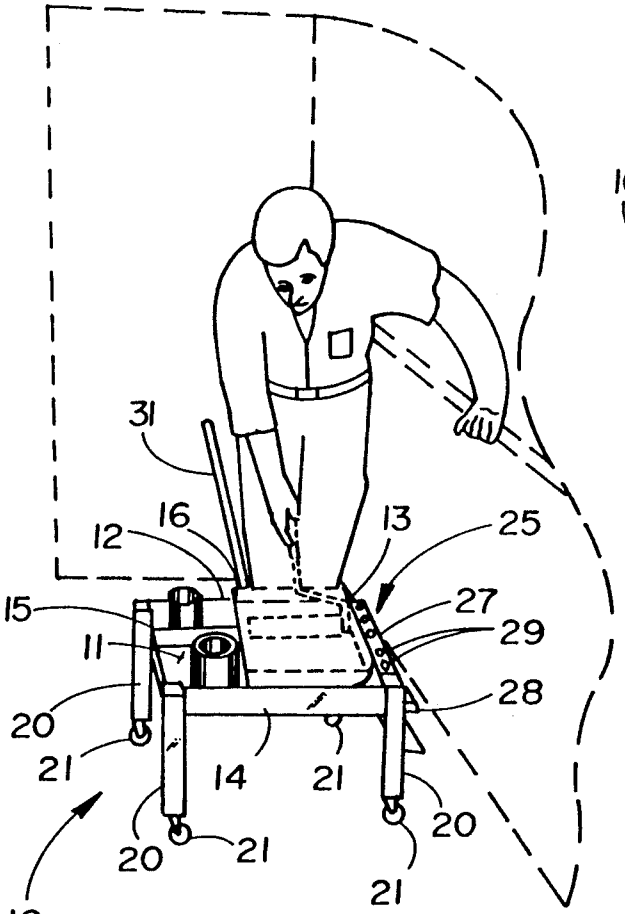
FIG. 1 is a perspective view of a first embodiment of the mobile work station of the present invention.

With reference to FIGS. 1-5, there is illustrated a mobile work station 10 for a painter or the like. The device has a rectangular tray 11 with side walls 12, 13, 14, 15 to form an open top receptacle. One or more dividers 16 are disposed within the tray to form compartments therein. The compartments are of dimensions such that equipment, such as a painter's pan for use with a paint roller applicator or a one (1) gallon can of paint, can be easily and securely placed in the compartment. Also, the compartment may be used for accessory equipment (such as sandpaper, wipes, paint brushes, tape, etc.) or for personal items (beverage, cigarettes, ash tray, etc.). As shown in FIG. 2, the tray may have a continuous surface, it may be a mesh-like surface or it may be continuous in one compartment and mesh-like 19 in another. For example, the compartment in which the pan for use with a roller applicator is preferably mesh-like 19 because there is a greater probability of paint spilling in this compartment and the mesh-like structure is less difficult to clean. Furthermore, the mesh-like structure reduces the total weight of the work station.

Figure 6A:
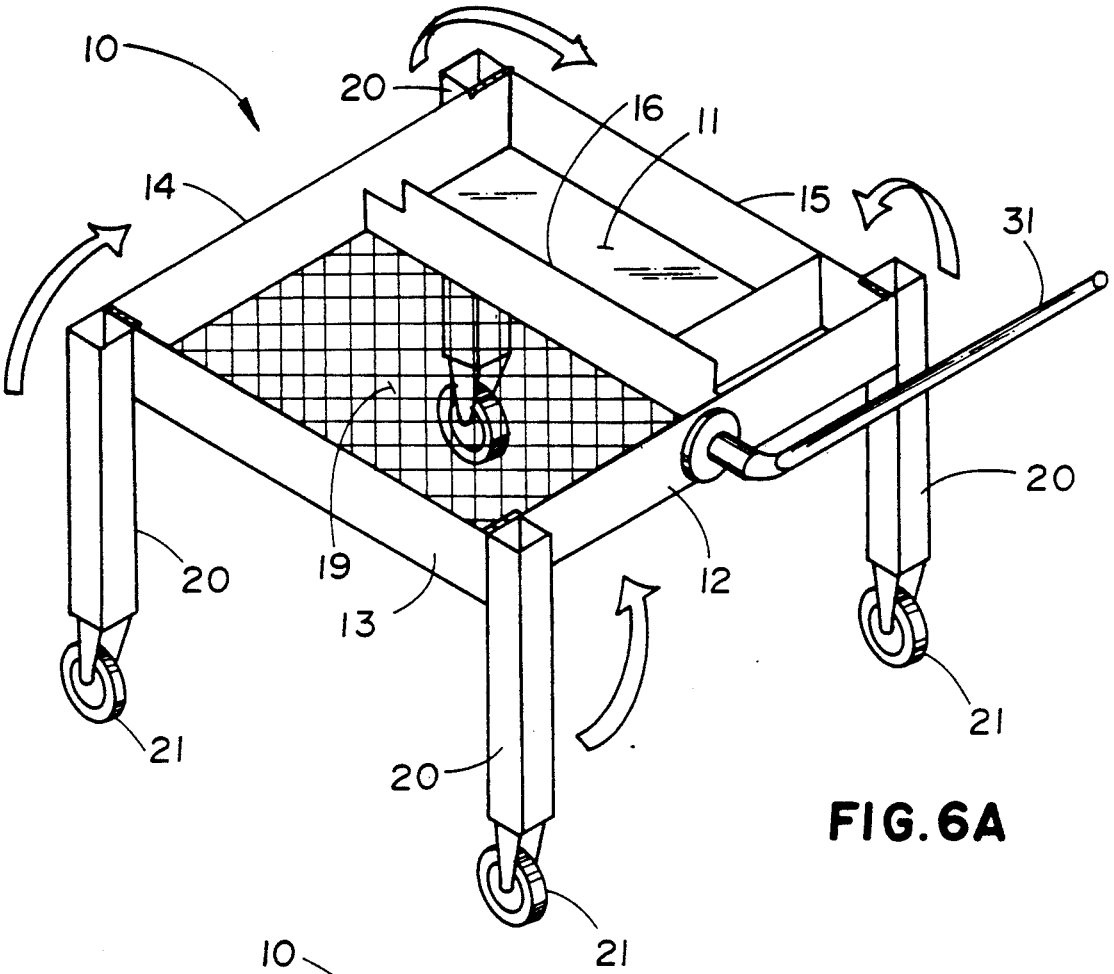
FIG. 6A is a perspective view of the mobile work station of FIG. 1, showing the legs in a depending position, and further showing the pivotal movement of the legs through 270° to a stored position.
Figure 6B:
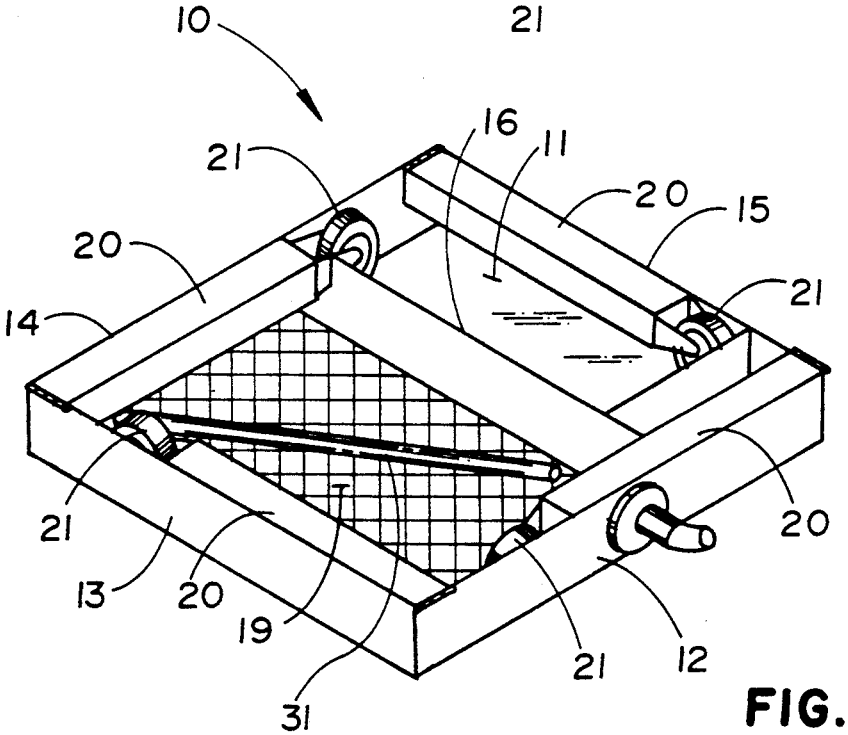
FIG. 6B is a perspective view of the mobile work station of FIG. 1, showing the legs in the stored position in the open top of their tray.
Figure 9:
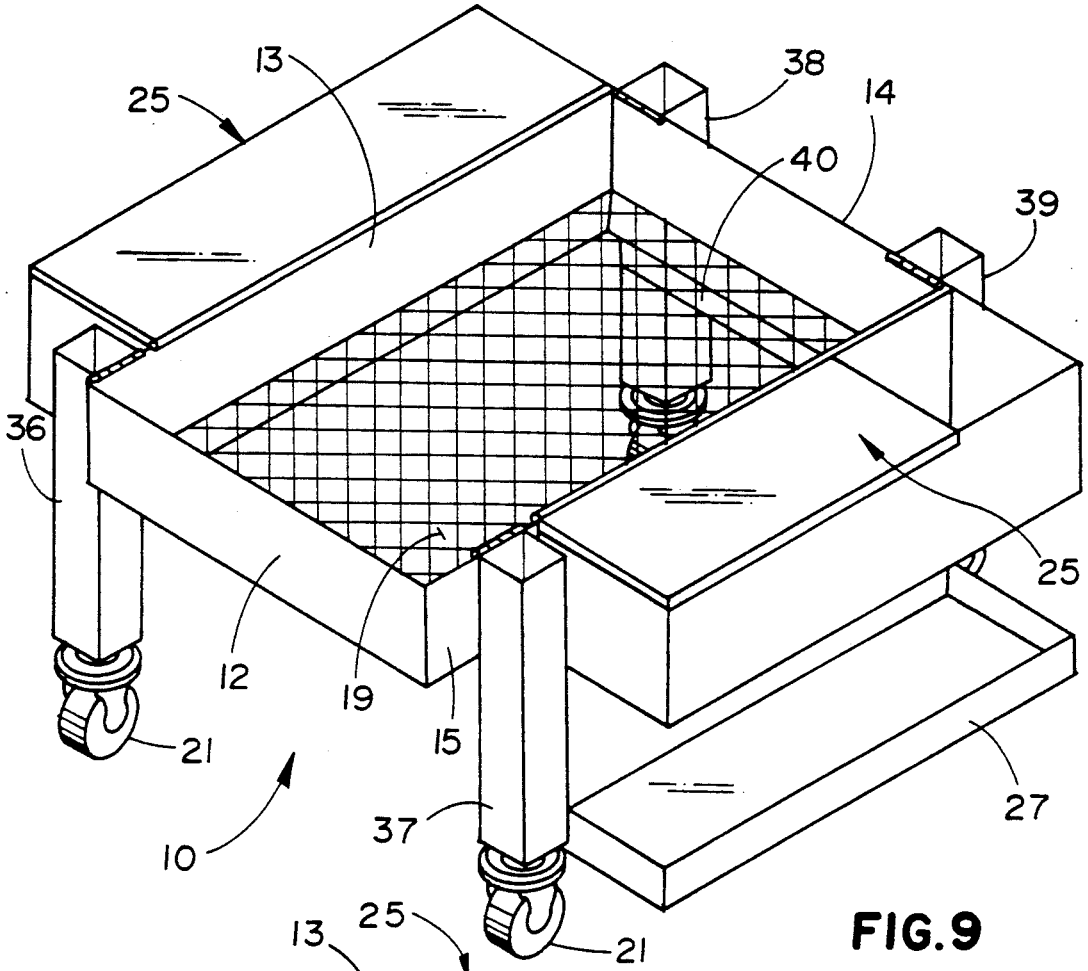
FIG. 9 is a perspective view of a second embodiment of the mobile work station of the present invention.
Figure 10:
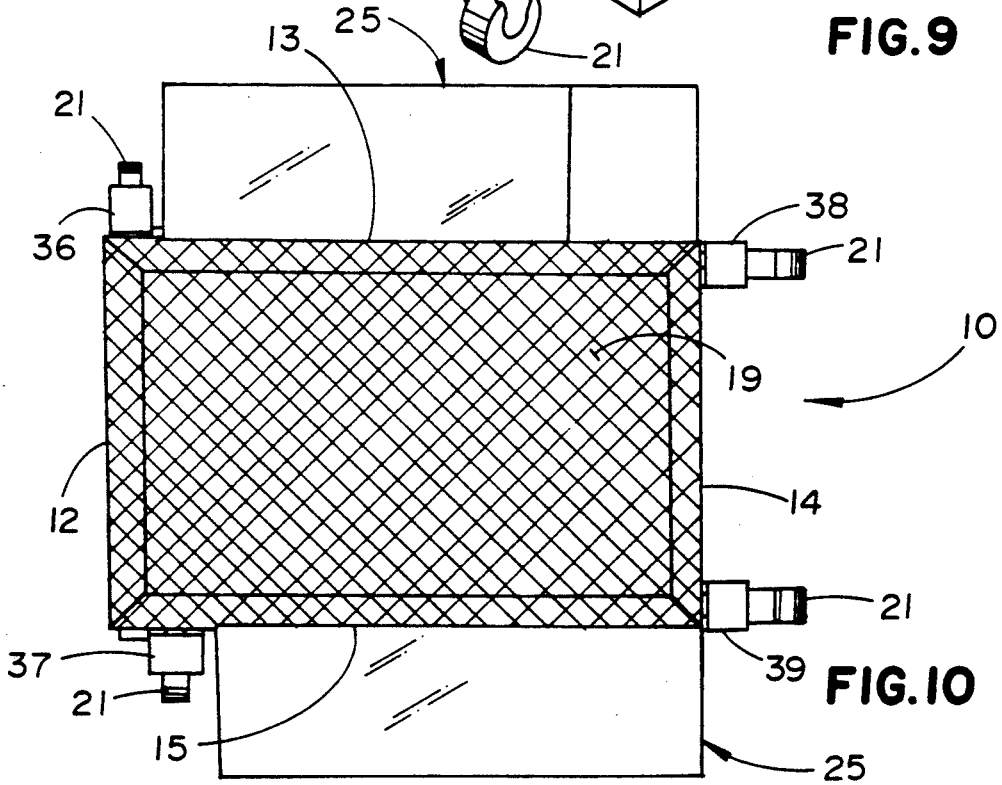
FIG. 10 is a top plan view of the mobile work station of FIG. 9.
Figure 11:
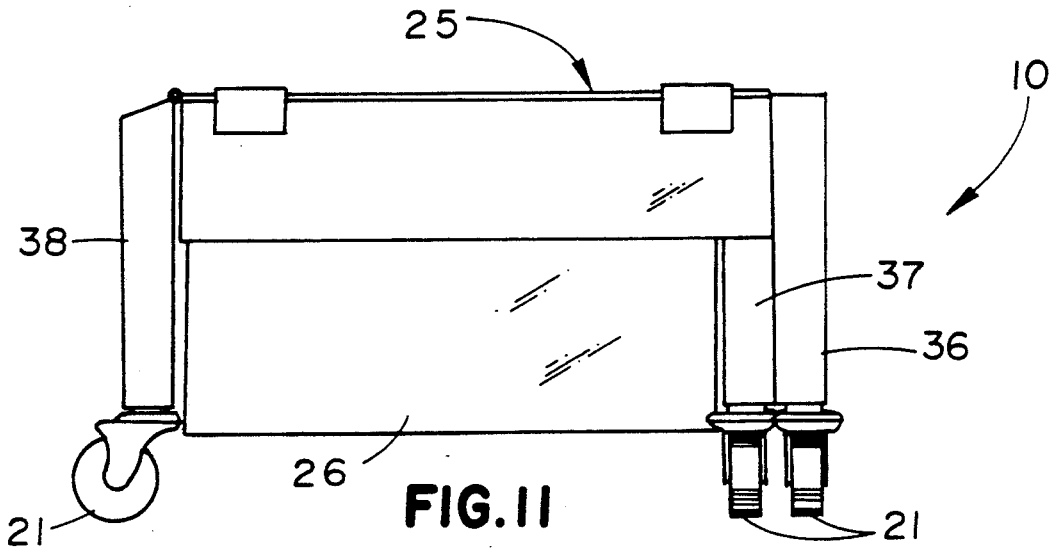
FIG. 11 is a side view thereof.
Figure 12:
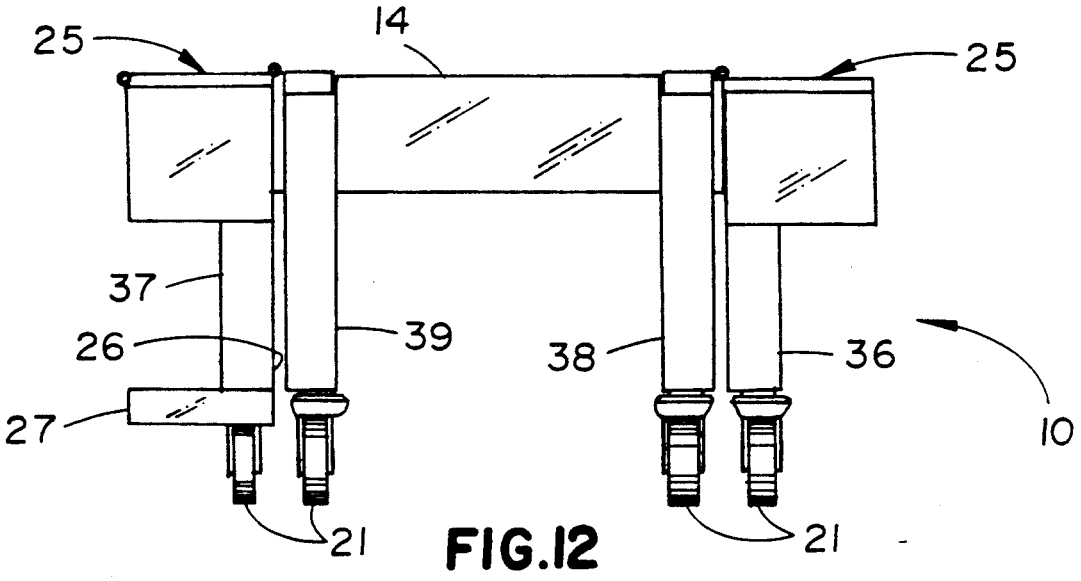
FIG. 12 is an end view thereof.

The work station has four legs 20, each leg having a first end and a second end. The first end of each leg is pivotally mounted on the tray 11. As shown in FIG. 6A, the legs may pivot through 270° to a first position in which the leg 20 is adjacent to the tray 11 and is stored in the open top of the tray 11. The legs in the stored position are shown in FIG. 6B. The legs 20 also have a second position in which the legs 20 depend downwardly from the tray 11 to support the tray 11. Means are provided to secure the legs 20 in both first and second positions so the legs may be secure in the collapsed or working position respectively.

Preferably, the leg height is approximately 13 in. to 18 in. as being most convenient with respect to reducing bending by the painter and obtaining a stable work station 10.

Casters 21 are carried by the second end of each leg 20 to enable the work station 10 to be easily rolled over a surface to facilitate movement of the work station and reduce movement and travel by the painter.

A handle 31 is also provided which may be removable or may otherwise be foldable to allow easy transport and storage. The handle 31 may be a painter's "shorty pole" which may be threadably connected with a complementary threaded fitting on the work station 10. The handle allows the painter to easily pull or push the work station 10 safely as the painter progresses from one work area to another work area. In addition, a deeper paint pan capable of holding more paint may be used without the risk of back injury to the painter or spillage of the paint.

A removable shelf 25 may also be provided as a receptacle for painter's tools and sundry items. The shelf has a back 26, at least one shelf 27, sides 28 and means for removably attaching the shelf 25 to the work station 10. If desired, the shelf may have a hinged or removable cover.

Figure 8:
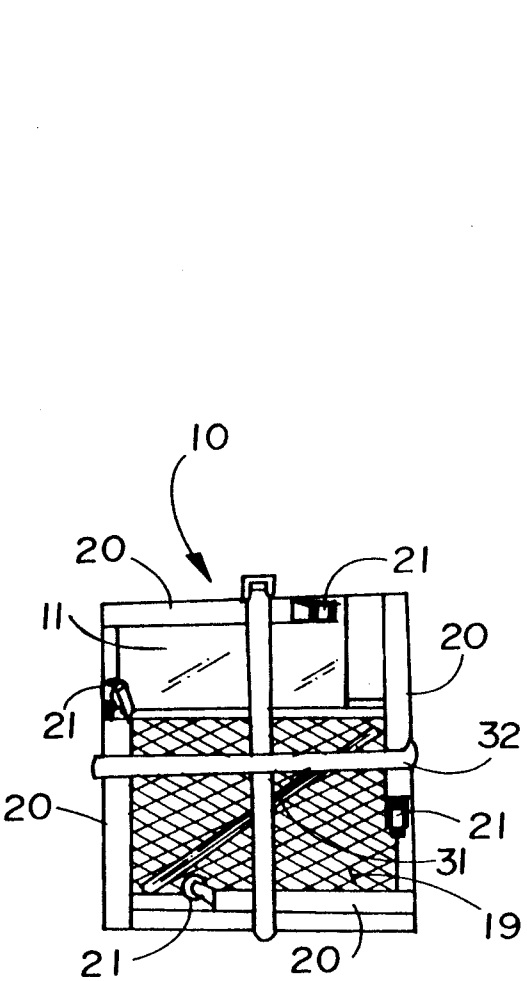
FIG. 8 is a perspective view of the mobile work station of FIG. 1, with the carrying strap disposed thereon.
Figure 7:
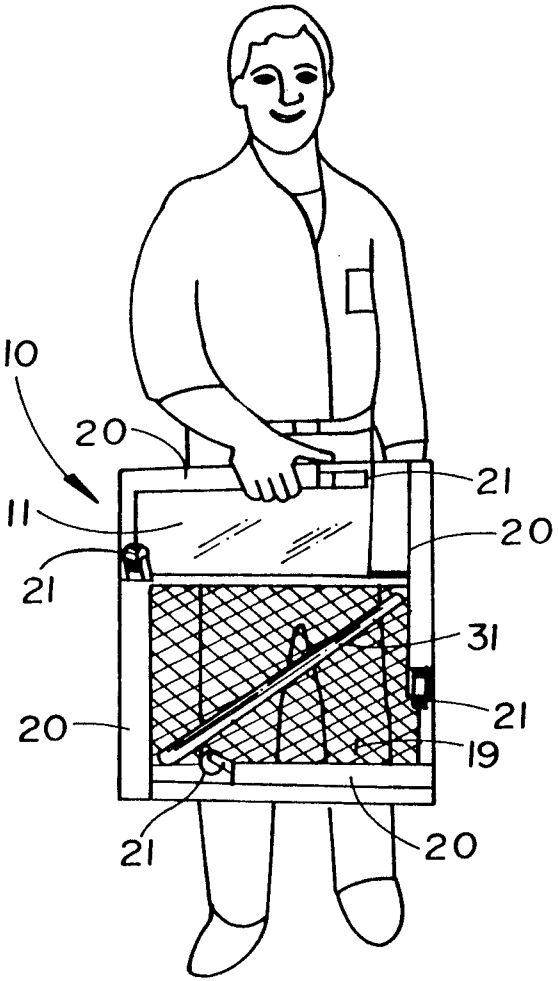
FIG. 7 is a perspective view showing a person holding the mobile work station of FIG. 1, wherein the legs have been folded to their stored position.
Figure 3:
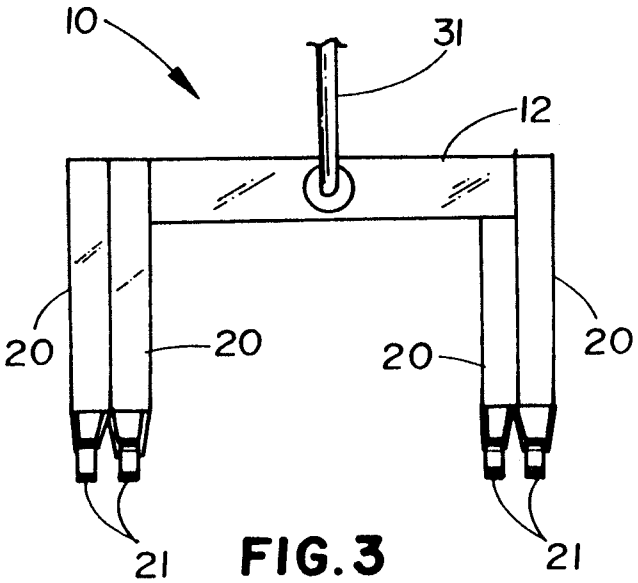
FIG. 3 is an end view thereof.
Figure 5:
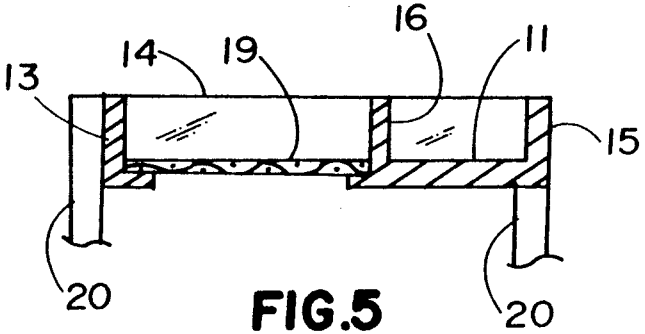
FIG. 5 is a cross-sectional view taken along the lines 5—5 of FIG. 2 (the thickness being exaggerated for ease of illustration).

As shown in FIG. 7, the work station 10 is relatively lightweight and is easily carried by a person in the collapsed position. The handle 31 may be conveniently placed across one of the compartments of the tray 11. A carrying strap 32 may be removably disposed about the tray 11 with the legs 20 in the first position adjacent to the inside of the tray 11, as in FIG. 8.

Figure 13:
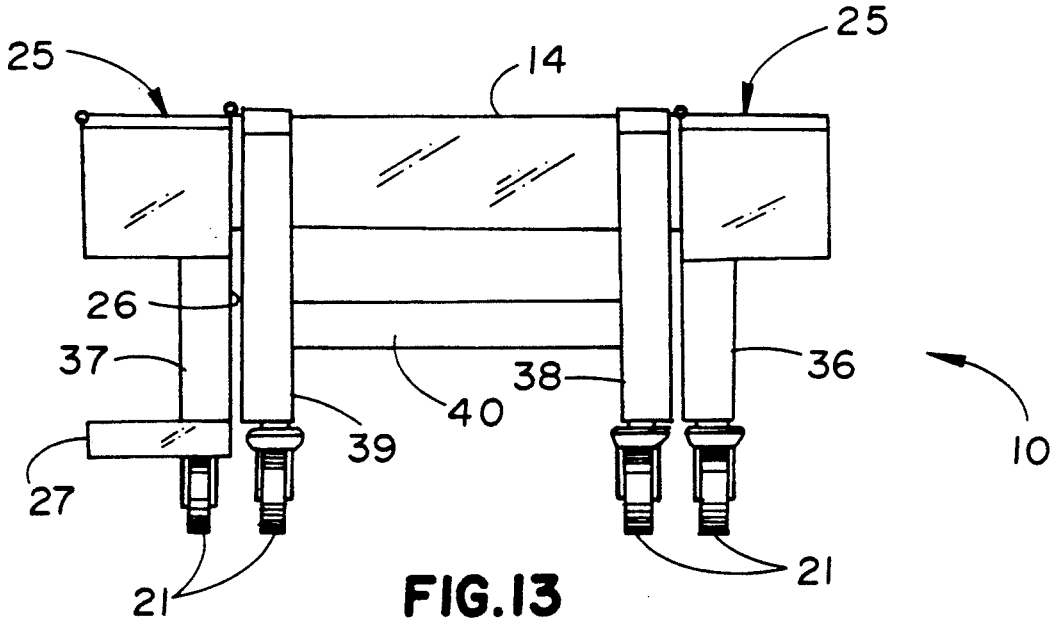
FIG. 13 is an end view thereof, wherein a transverse bar connects two legs.
Figure 14A:
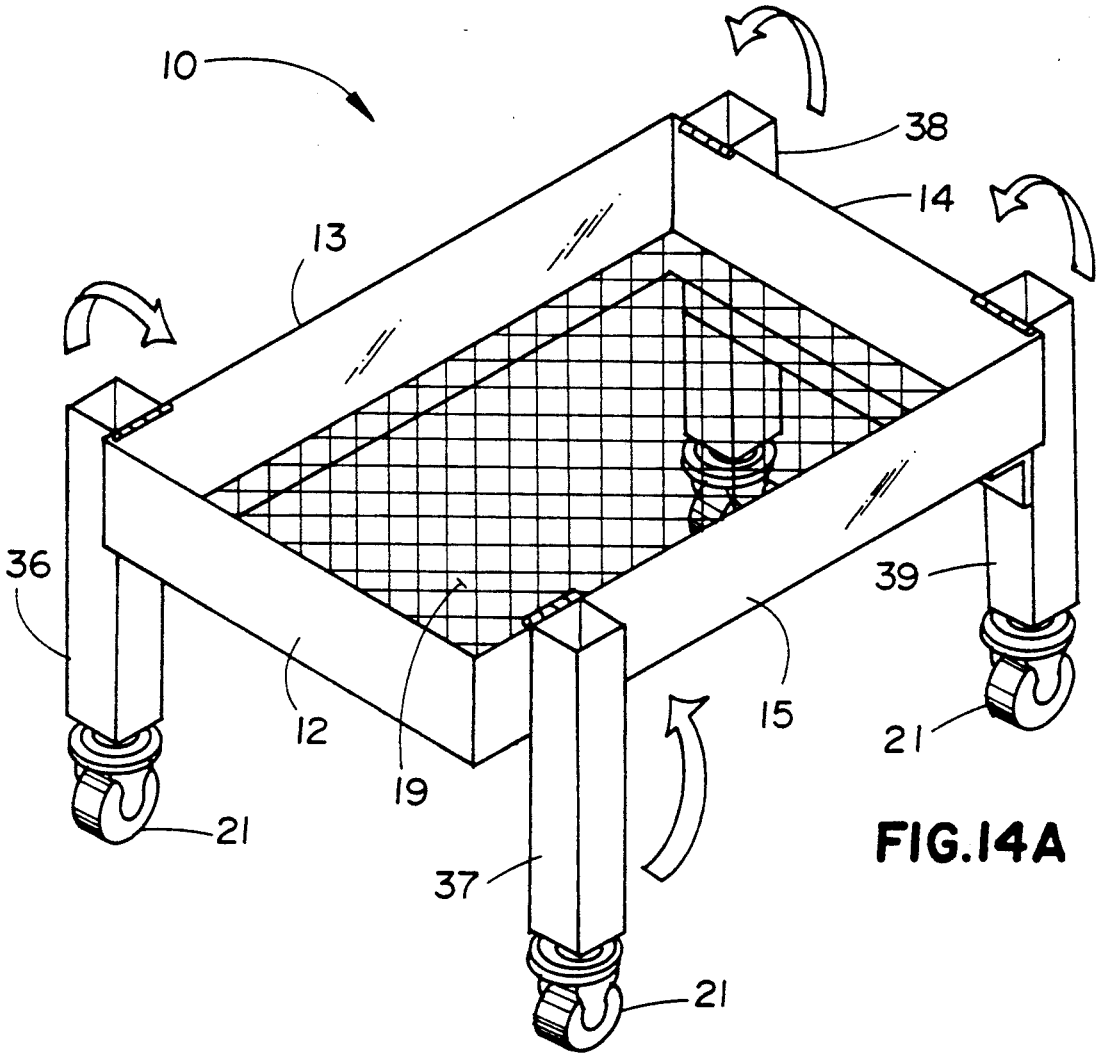
FIG. 14A is a perspective view of the mobile work station of FIG. 9, showing the legs in a depending position, and further showing the pivotal movement of the legs through 270° to a stored position.
Figure 14B:
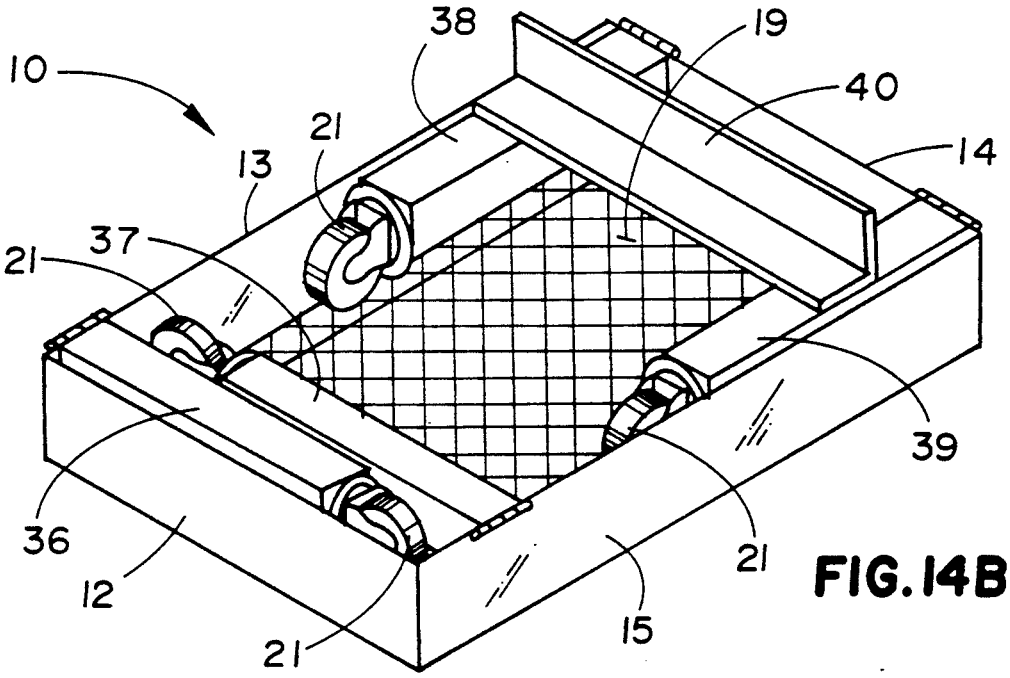
FIG. 14B is a perspective view of the mobile work station of FIG. 9, showing the legs in the stored position in the open top of the tray.
Figure 15B:
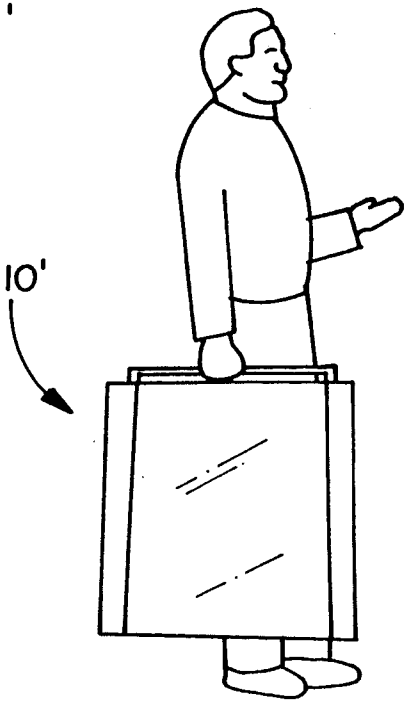
FIG. 15B is a perspective view of the embodiment of FIG. 15 being carried by a user.
Figure 15A:
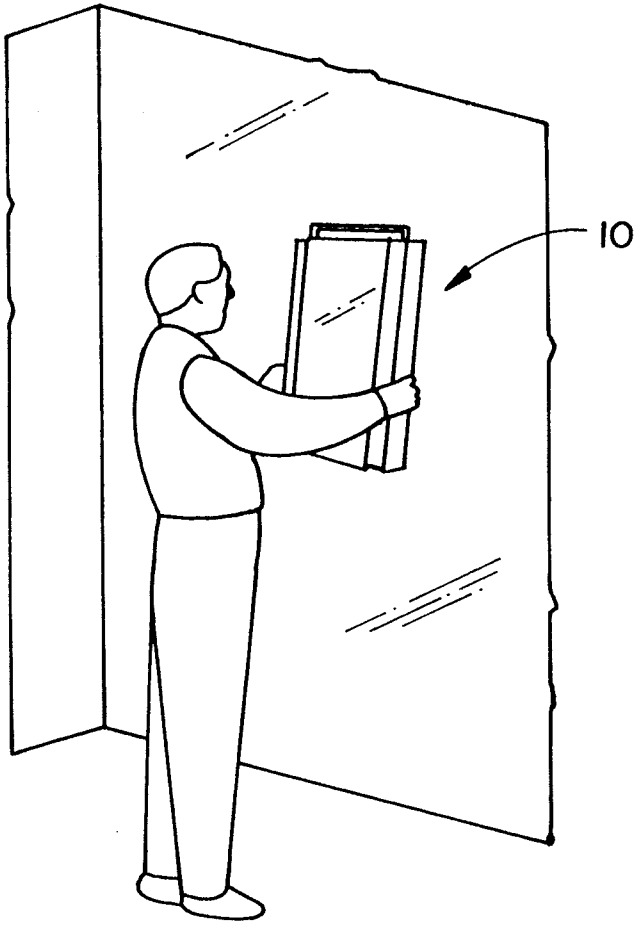
FIG. 15A is a perspective view of the embodiment of FIG. 15 mounted on a wall for storage.
Figure 15:
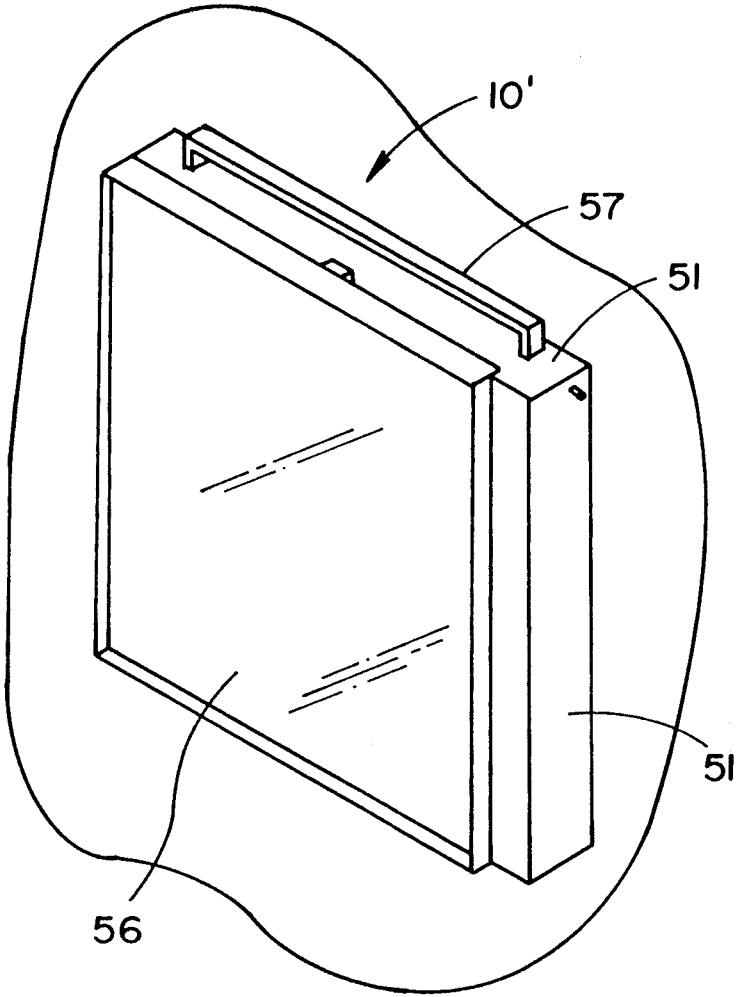
FIG. 15 is a perspective view of a third embodiment of the mobile work station of the present invention.
Figure 16A:
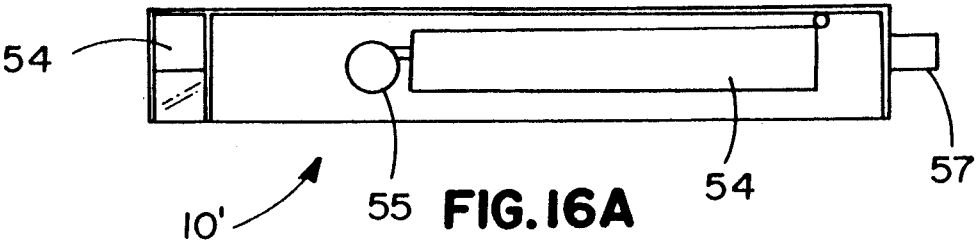
FIG. 16A is a cross section view along the lines 16A—16A of FIG. 16.
Figure 16B:
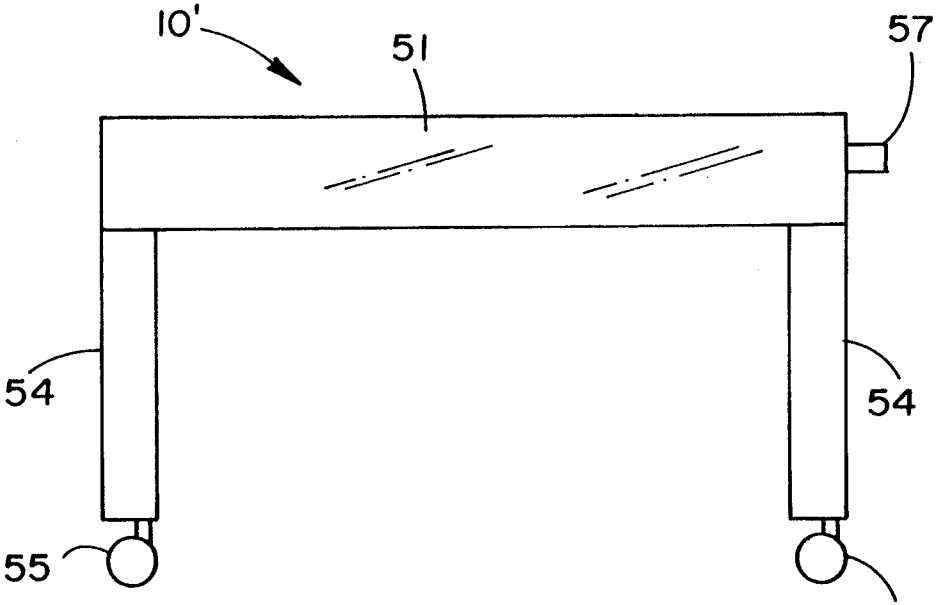
FIG. 16B is a side elevation view of the embodiment of FIG. 15, showing the legs placed in the downward depending position.
Figure 16:
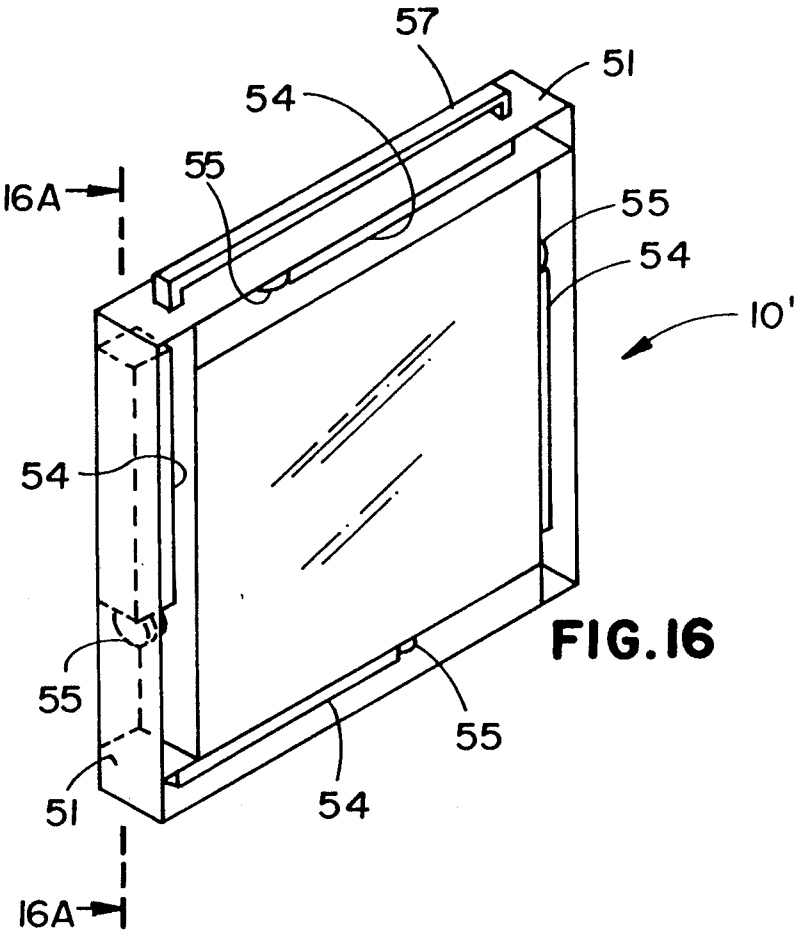
FIG. 16 is a perspective view of the underside of the embodiment of FIG. 15.

FIGS. 9-14B show a second embodiment (constituting a first alternate embodiment) of the work station 10 in which one leg 36 is pivotally mounted on the second side wall 13 substantially at the corner of the second side wall 13 and the first side wall 12. A second leg 37 is pivotally mounted on the fourth side wall 15 near the first side wall 12. The third leg 38 and fourth leg 39 are pivotally mounted on the third side wall 14; the third leg 38 is near the second side wall 13 and the fourth leg 39 is near the fourth side wall 15. The legs 36-39 are capable of pivoting substantially 270° (FIG. 14A) such that the legs 36–39 have a first position in which the legs 36–39 are stored in the open top of the tray 11 and such that the legs 36–39 have a second position in which each leg 36–39 depends downwardly from the tray 11 and supports the tray 11. In the stored position, the first leg 36 is disposed adjacent to the second leg 37 as shown in FIG. 14B.

As shown in FIGS. 13, 14A and 14B, leg 38 and leg 39 may be connected by a transverse bar 40 therebetween so that both legs 38, 39 are moved simultaneously between the first stored position and the second supporting position.

The first alternate embodiment may also have compartments and removable shelves.

With reference to FIGS. 15–25, there is disclosed a third embodiment (constituting a second alternate embodiment) of the present invention, which is preferred for commercial painters and painting contractors. This third embodiment comprises a mobile work station 10′ which is somewhat larger than the previously described embodiments. The mobile work station 10′ is capable of handling larger paint pans and larger containers of paint, plaster, spackling material and the like—all of which are more likely to be used by a professional or commercial painter or painting contractor. The work station 10′ is compact, may be folded into a relatively small size, and is relatively lightweight. Accordingly, the mobile work station 10′ may be easily stored in the shop or in a van, may be easily carried to the job site, and may be easily set up for use on the job.

The work station 10′ has a frame 50 which has side walls 51 to form an open well 52 substantially in the center of the frame 50. A tray 53, having side walls and a bottom, is mounted in the well 52. The side walls of the tray have sufficient height (i.e. the tray in deep enough) for the disposition of a paint roller, a paint pan, brushes and the like within the tray. Since this embodiment is adaptable for commercial applications, the tray can accomodate large paint pans, large rollers and five gallon containers of paint.

Figure 17C:
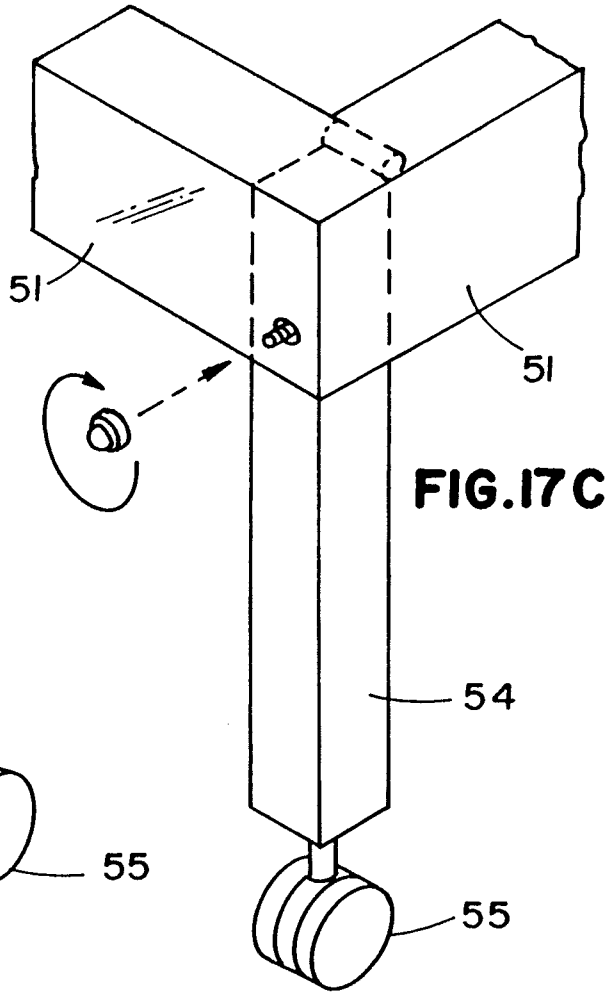
FIGS. 17A-17C are perspective views of the embodiment of FIG. 15 showing one leg (in broken lines) pivotally mounted in the frame. The other legs have been omitted for ease and illustration.
Figure 17B:
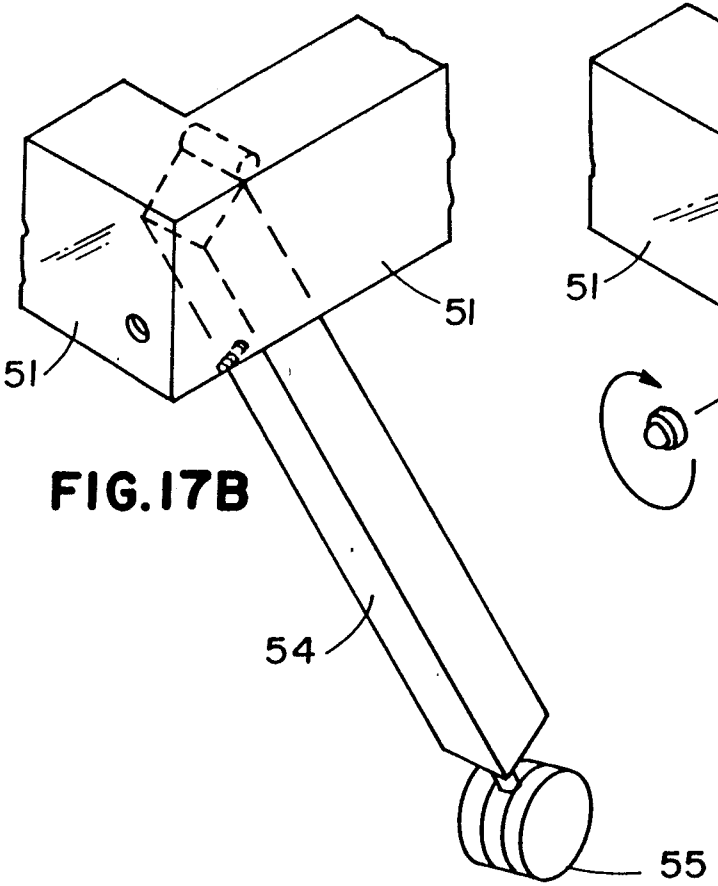
Figure 17A:
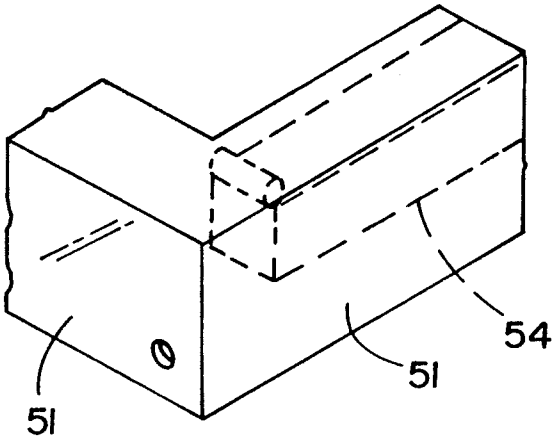

A plurality of legs 54 (preferably four) are provided, each leg 54 having a first end 54A and a second end 54B. The first end 54A of each leg 54 is mounted on the frame 50; and each leg 54 is capable of being pivoted, such that each leg 54 has a first position in which the leg 54 is adjacent to the frame 50, and further has a second position in which each leg 54 depends downwardly to support the frame 50. (FIGS. 17A–17C).

Means are provided to secure each leg 54 in the first position and in the second position, respectively. The securing means may be detent, a bolt and nut, a brace or other means known to persons skilled in the art. The second end 54B of each leg 54 may have a caster 55 thereon to improve the mobility of the work station 10′.

Figure 19:
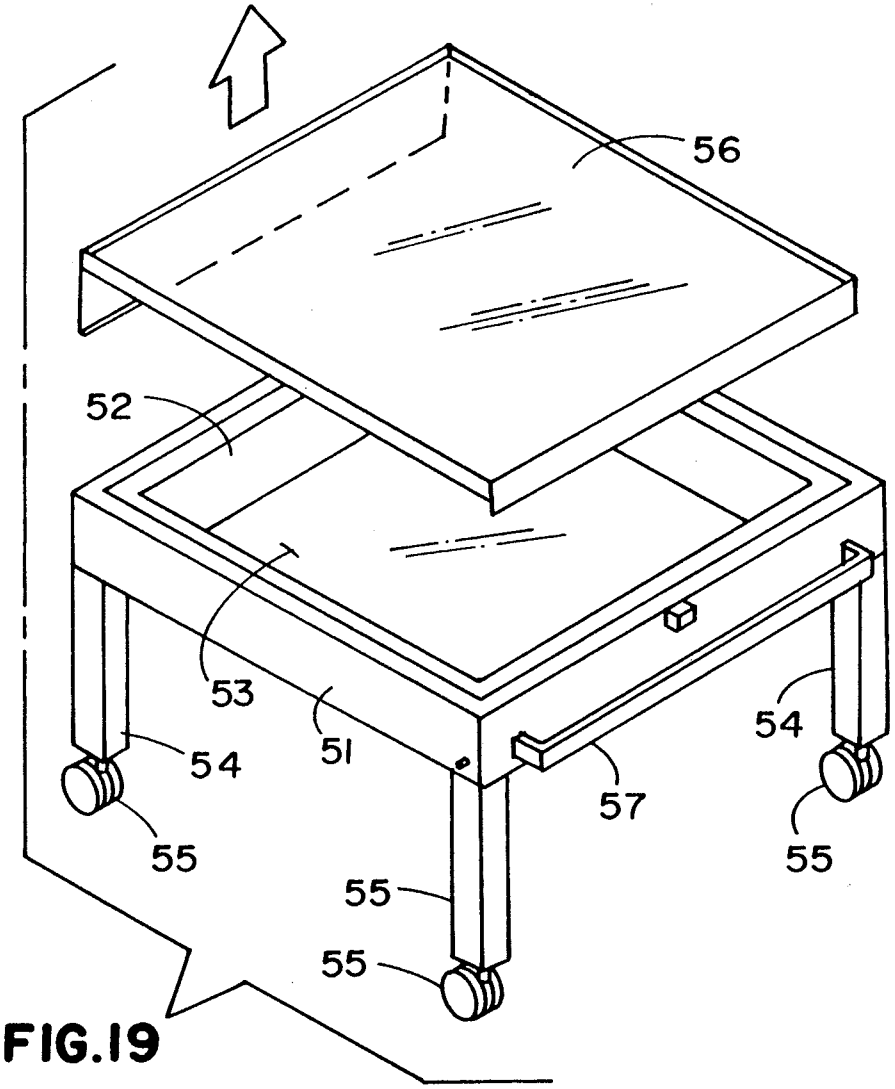
FIG. 19 is a perspective view of the embodiment of FIG. 15 showing the cover removed.
Figure 18:
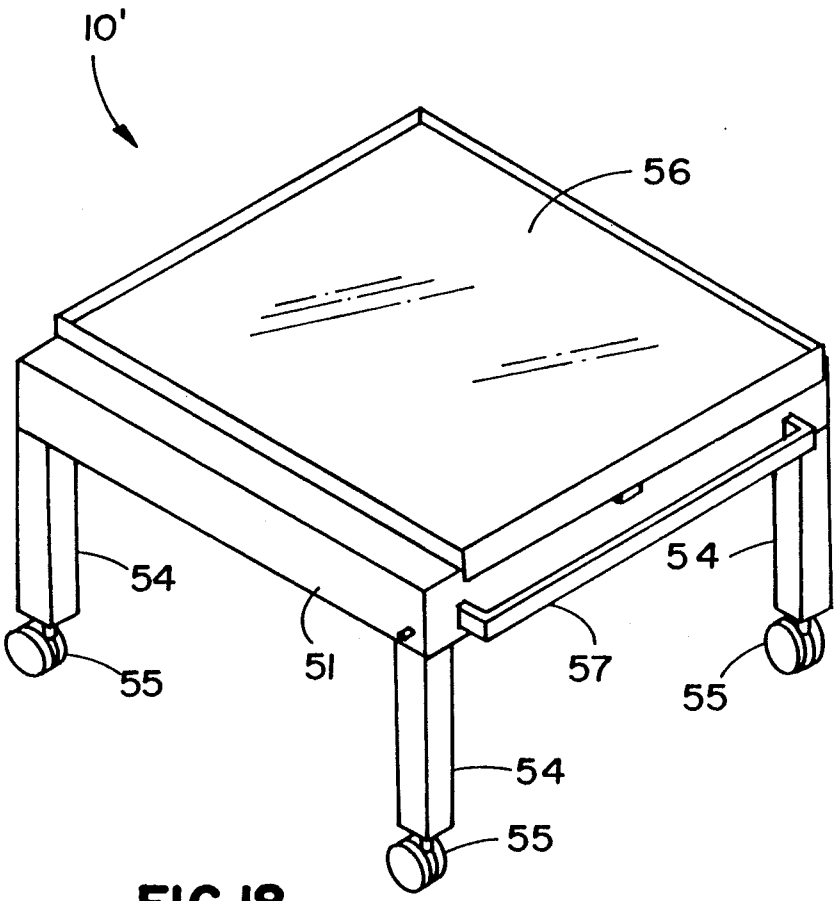
FIG. 18 is a perspective view of the embodiment of FIG. 15 showing the work station supported on its legs.

A cover 56 is removably attached to the frame 50 such that, when attached, the cover 55 encloses the open well 52 in the frame 50. Thus, the tray 53 and any contents of the tray 53 are contained within the frame 50, and the mobile work station 10′ may be transported conveniently. (FIGS. 18–19).

Figures 20, 21:
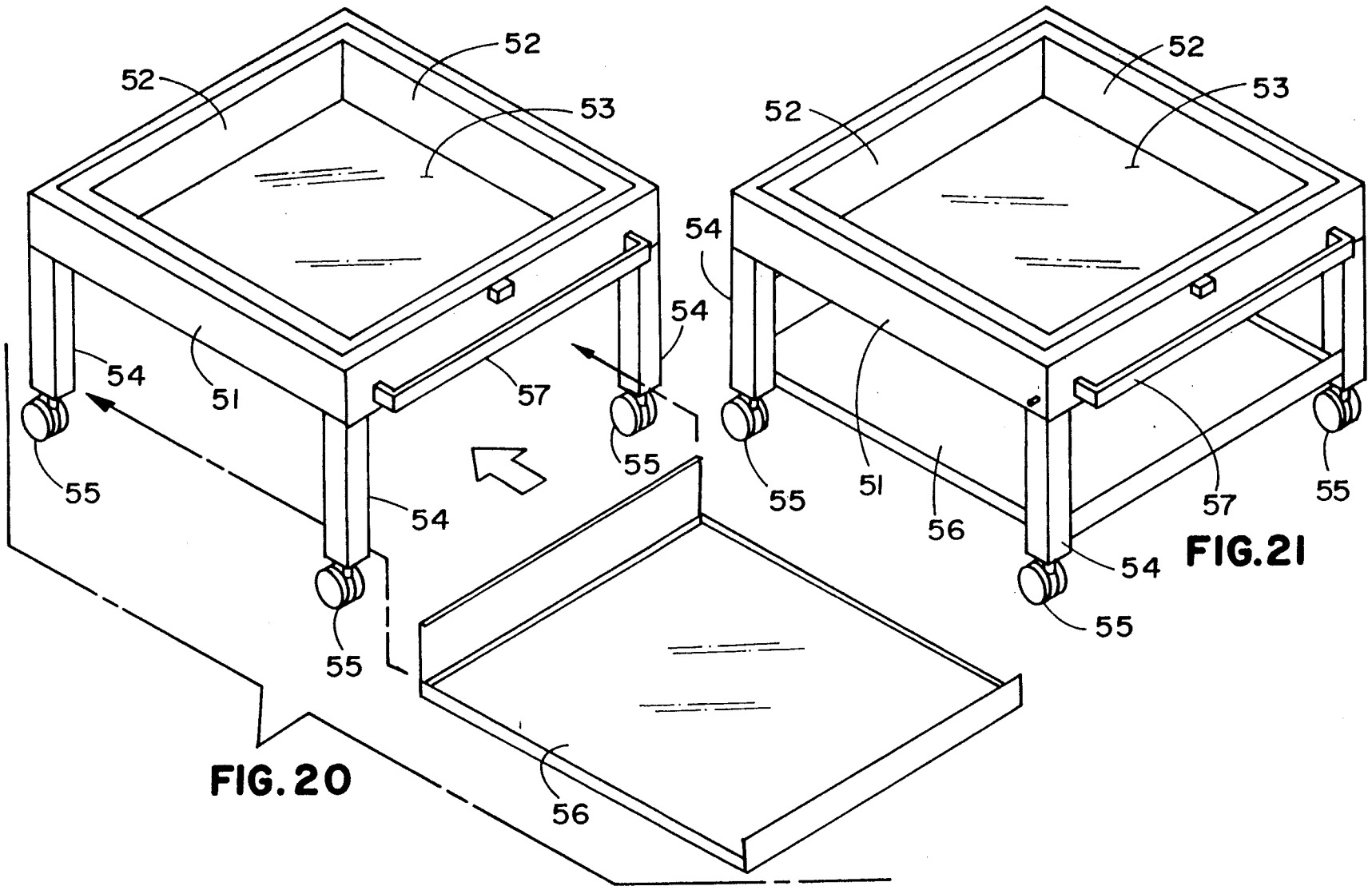
FIG. 20 is a perspective view of the embodiment of FIG. 15 showing the cover disposed between the legs, thereby forming a shelf, and thereby providing additional structural rigidity for the mobile work station.
FIG. 21 is a perspective view of the embodiment of FIG. 15 showing the device available for use.

When the cover 55 is detached from the frame 50, the cover 55 may be disposed between the depending legs 54 (when the legs are in their second, depending position) and the cover 55 may be removably secured to the legs 54. (FIGS. 20–21). In such a manner, the cover 55 further supports the legs 54 in their downwardly-depending second position and provides additional structural integrity for the mobile work station 10′. Moreover, in this disposition between the legs 54, the cover 55 also serves as a shelf for carrying articles thereon.

Figure 23:
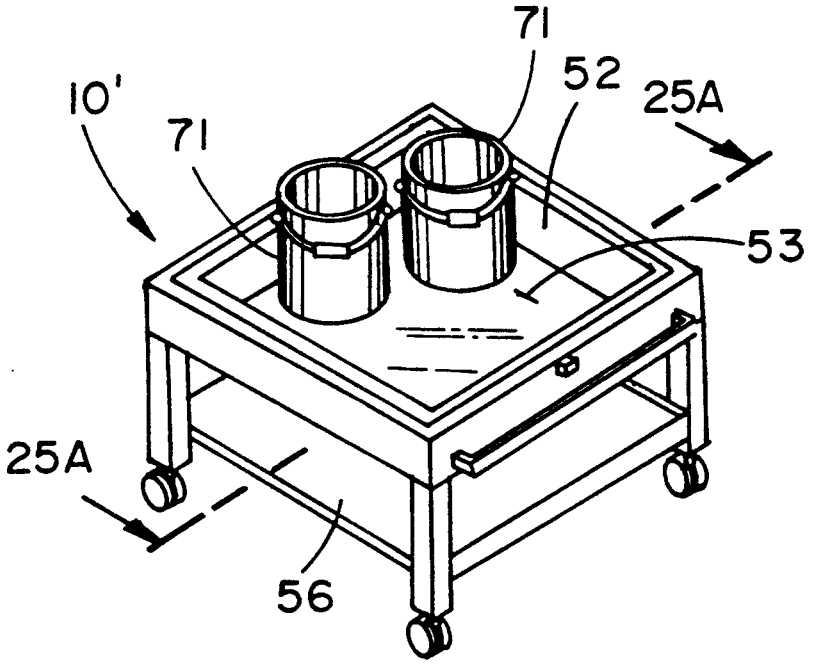
FIG. 23 is a perspective view of the embodiment of FIG. 15 showing large containers stored on the shelf.

As shown in FIG. 23, the tray 53 may be removed; and the mobile work station 10′ may be used with large containers of supplies and materials, such as a five-gallon paint can, which is supported by the cover 55 in its role as a shelf disposed between the legs 54.

Also provided is a means for moving the mobile work station 10′. This may be a rigid handle 57 which is connected to the frame 50. Alternately, the handle may be a flexible means attached to the frame 50. The means for moving the mobile work station 10′ is positioned in a manner so that it may be easily grasped by the painter. The rigid handle permits the painter to either push or pull the mobile work station 10′ more easily than the flexible means, but the flexible means contributes to compactness. The handle 57 may also serve to carry and transport the device 10′ when the device has been collapsed after use.

Figure 24:
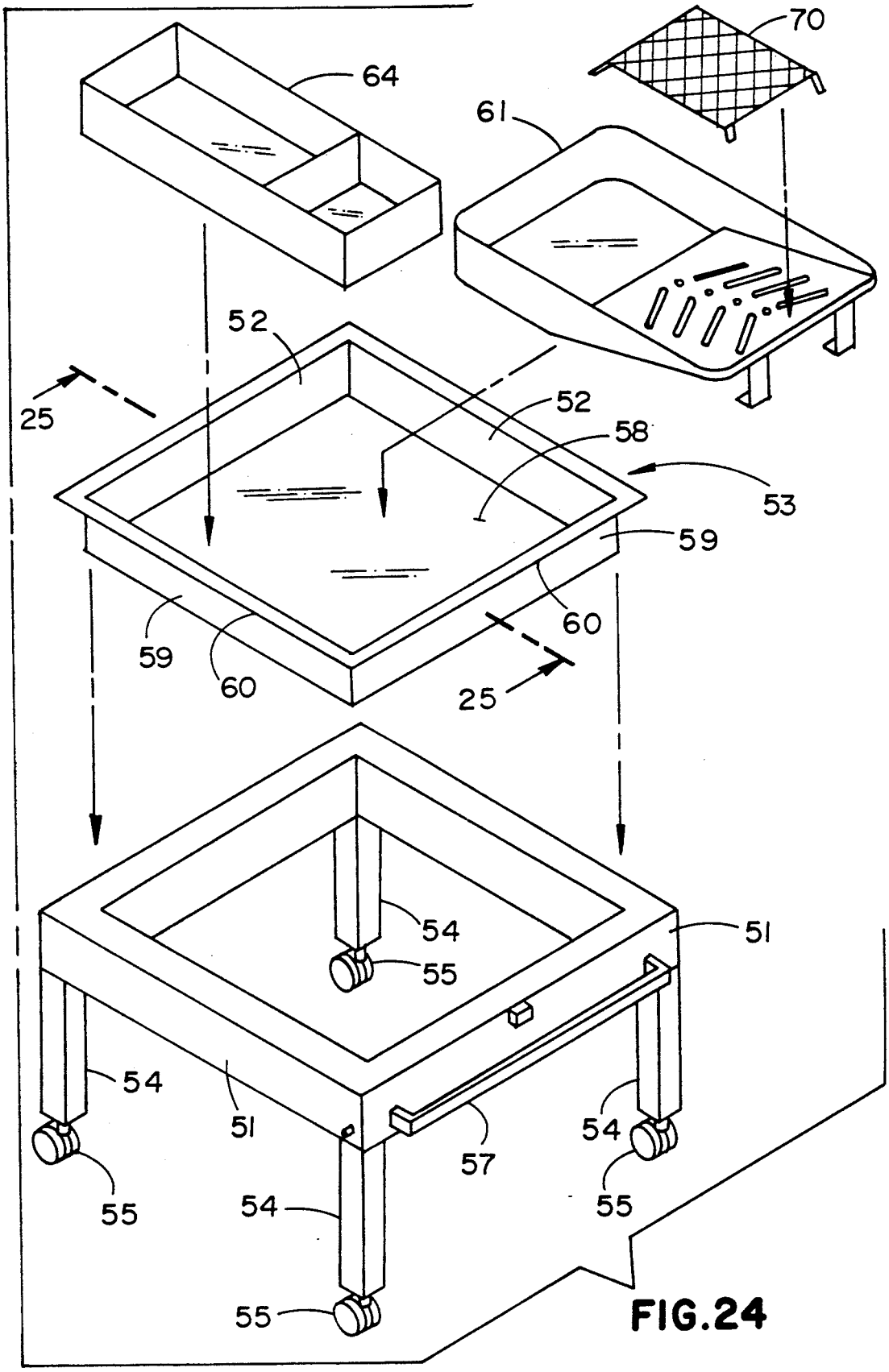
FIG. 24 is an exploded perspective view of the embodiment of FIG. 15.
Figure 25:
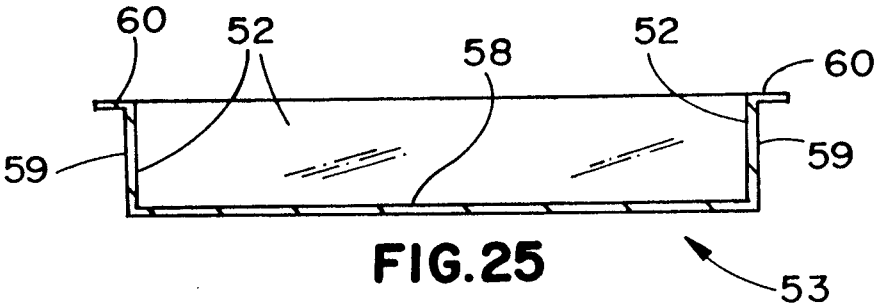
FIG. 25 is a cross sectional view taken across the lines 25—25 of FIG. 24.
Figure 25A:
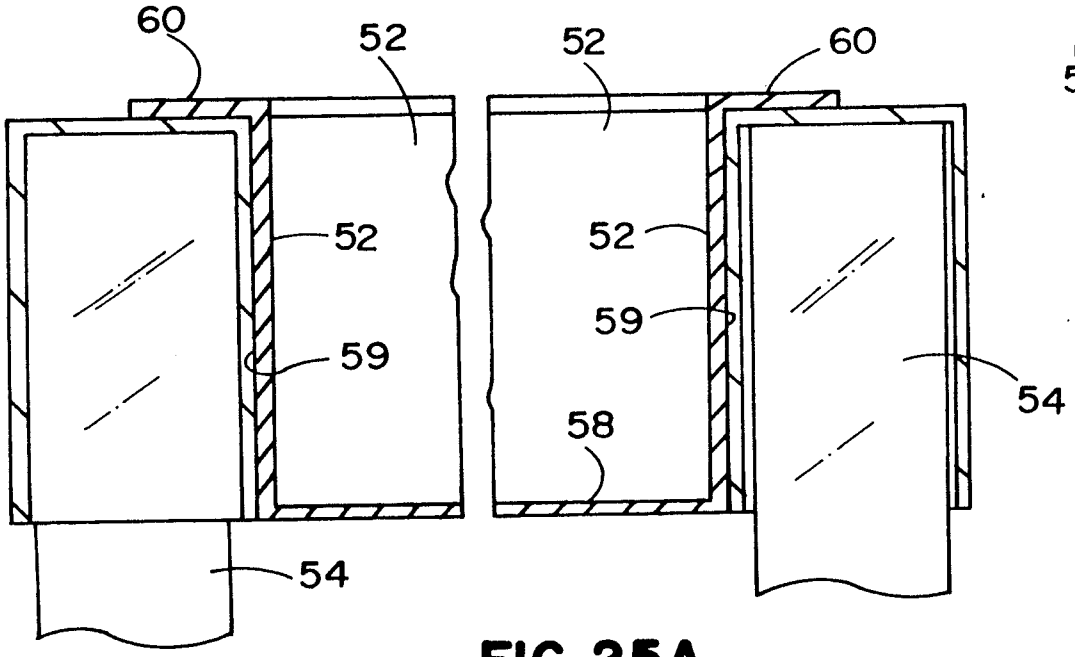
FIG. 25A is a cross sectional view taken across the lines 25A—25A of FIG. 23.

The tray 53 has a bottom 58 and side walls 59. The top of each side wall 59 has a flange 60 formed thereon (FIGS. 24 and 25). The flange 60 may be supported by the frame 50 so that the tray 53 may be disposed in the well 52 in the frame 50. In this manner, the tray 53 may be easily placed in the frame 50 and removed from the frame 50 when desired. This permits ease of cleaning of the tray 53 and also permits removal of the tray 53 when the cover 56 is being used as a shelf to support large containers (as previously described). The tray 53 may be fabricated of metal or plastic.

Figure 22:
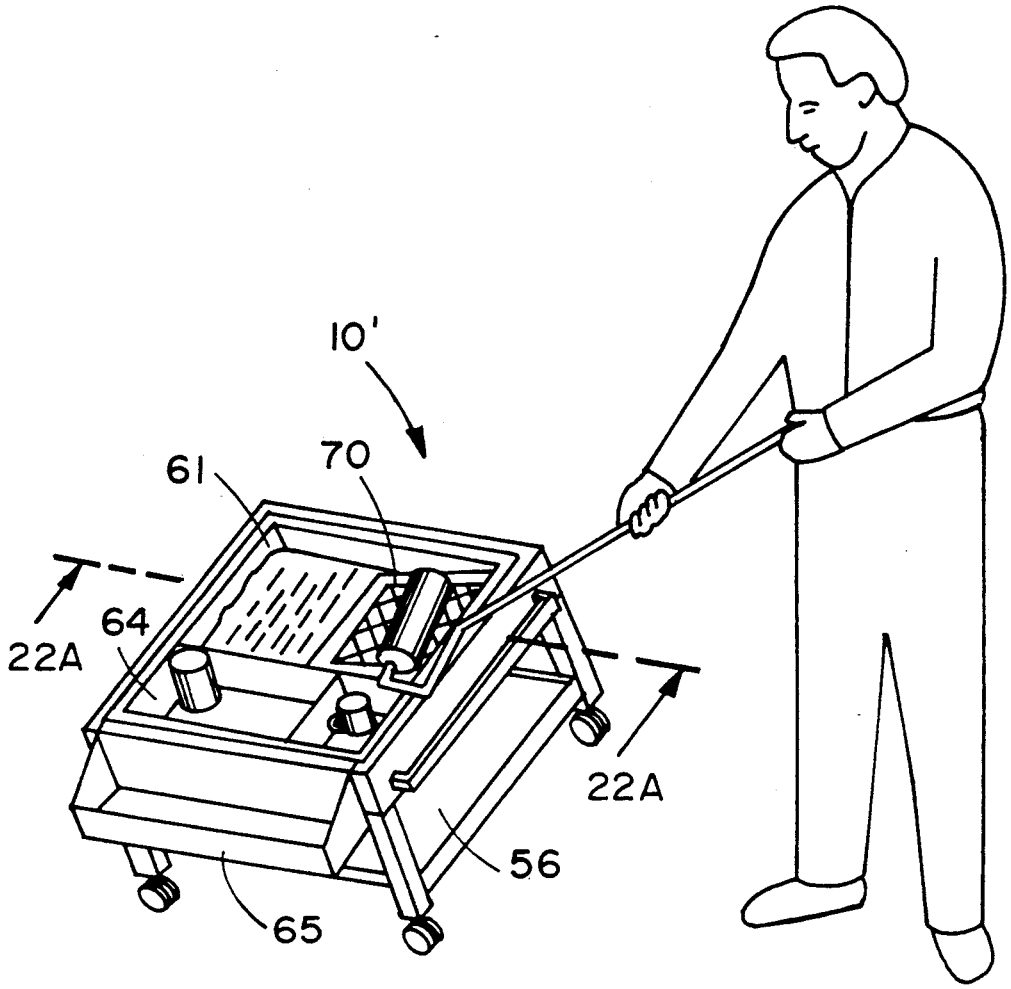
FIG. 22 is a perspective view of the embodiment of FIG. 15 in a typical use.
Figure 22A:
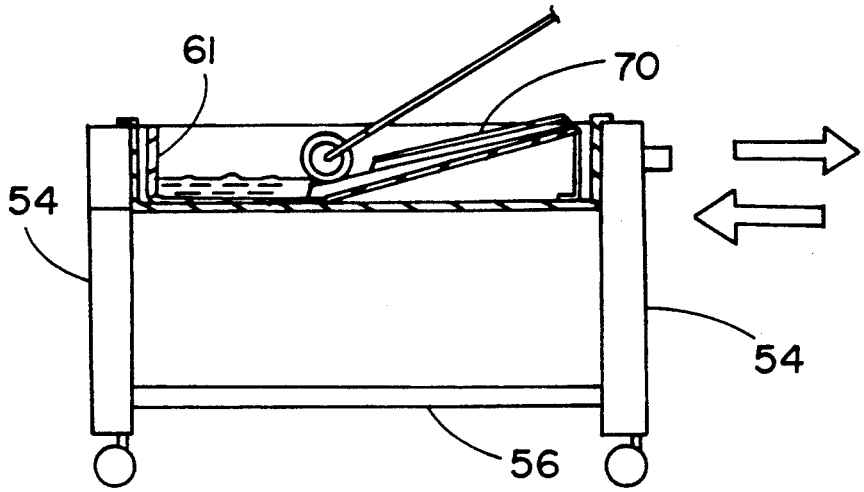
FIG. 22A is a cross sectional view taken along the lines 22A—22A of FIG. 22.

The dimensions of the tray 53 permit the placement of a standard painter's pan 61 within the tray 53 (FIG. 22). Preferably, the tray 53 is configured such that the positioning of the painter's pan 61 in the tray 53 is limited, and such that the pan 61 must be oriented towards the handle 57.

The paint pan 61 has a deeper end 62 and a shallower end 63, and a paint roller, may be dipped in the paint at the deeper end 62 and rolled towards the shallower end 63 to remove excess paint. This is more properly accomplished when the painter is positioned towards the shallower end 63 of the pan 61. Since the painter should be positioned near the handle 57 on the mobile work station 10′, the orientation of the paint pan 61 is such that the shallower end 63 of the paint pan 61 is towards the handle 57, and the deeper end of the pan 61 is away from the handle 57. The dimensions of the tray 53, preferably, do not permit the paint pan 61 to be disposed in the tray 53 in any other orientation.

Figure 27A:
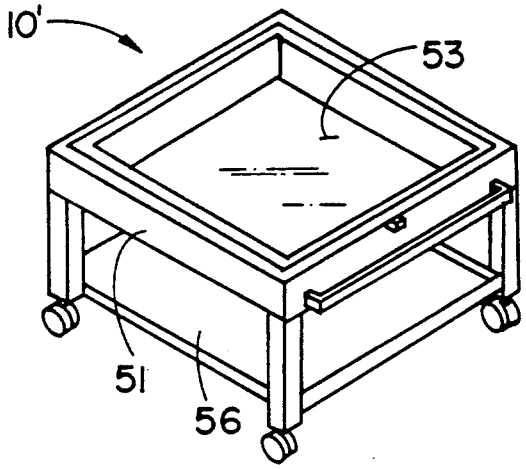
FIGS. 27A-27D are perspective views of the embodiment of FIG. 15 showing the removal of the tray and the placement of a large container on the cover which is serving as a shelf.
Figure 27B:
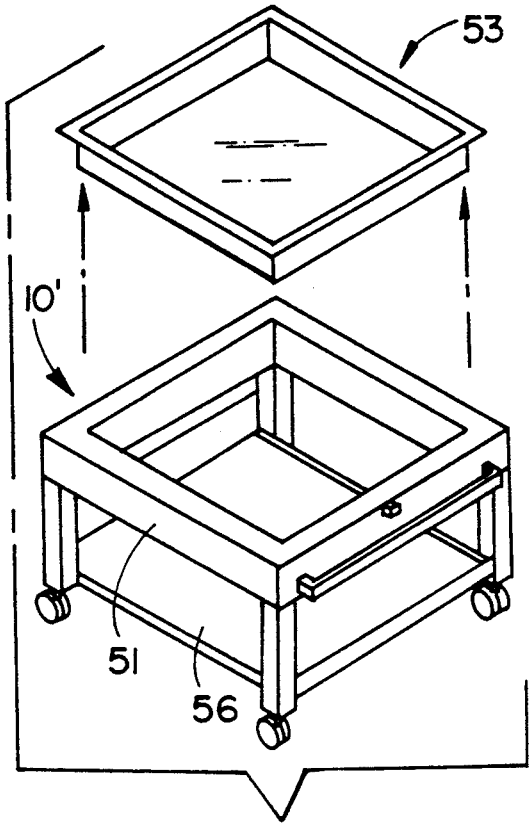
Figure 27C:
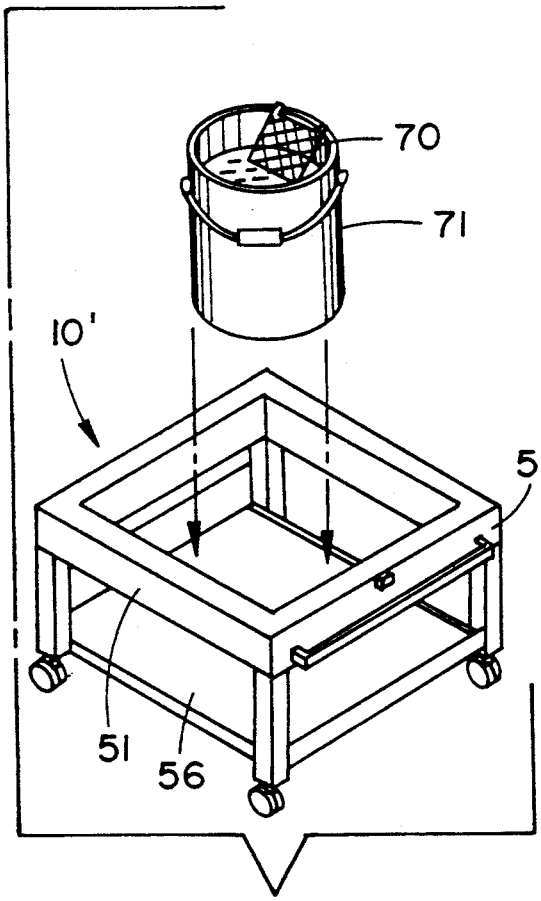
Figure 27D:
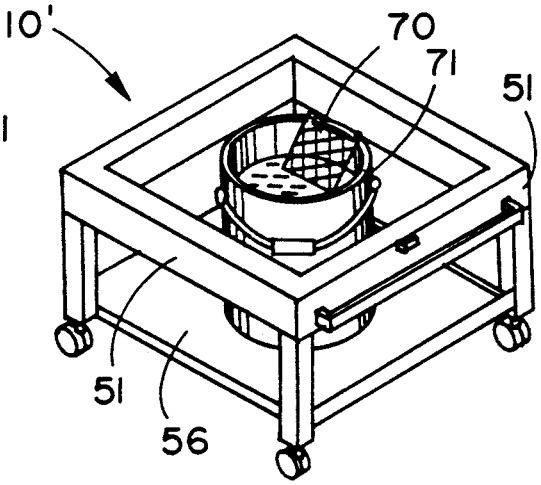

A metal mesh grid 70 may also be placed on the shallow end 63 of the pan 61 to improve the removal of excess paint from the roller before applying paint to a surface. The grid 70 is more efficient in removing the excess paint and the disposition of the grid 70 permits the excess paint to drain into the pan 61. The grid 70 usually has legs at both ends such that one end maybe clipped to the pan 61 or to the tray 53 and the other end may rest on the pan 61. A pair of slots may be disposed in the tray 53 or the frame 51 to receive the legs on the grid 70 and to secure the grid 70 in a desired position. Alternately, (FIG. 27C) the grid 70 may be disposed inside the five gallon bucket 71 with the legs on one end of the grid 70 attached to the upper lip of the bucket 71 and the other end extending into the bucket 71. In this manner, the painter may immerse the roller into the paint in the bucket, remove the excess paint on the grid 70 and apply the roller to the surface to be painted. This permits the painter to paint more rapidly without transferring the paint to a paint pan 61.

Figure 22B:
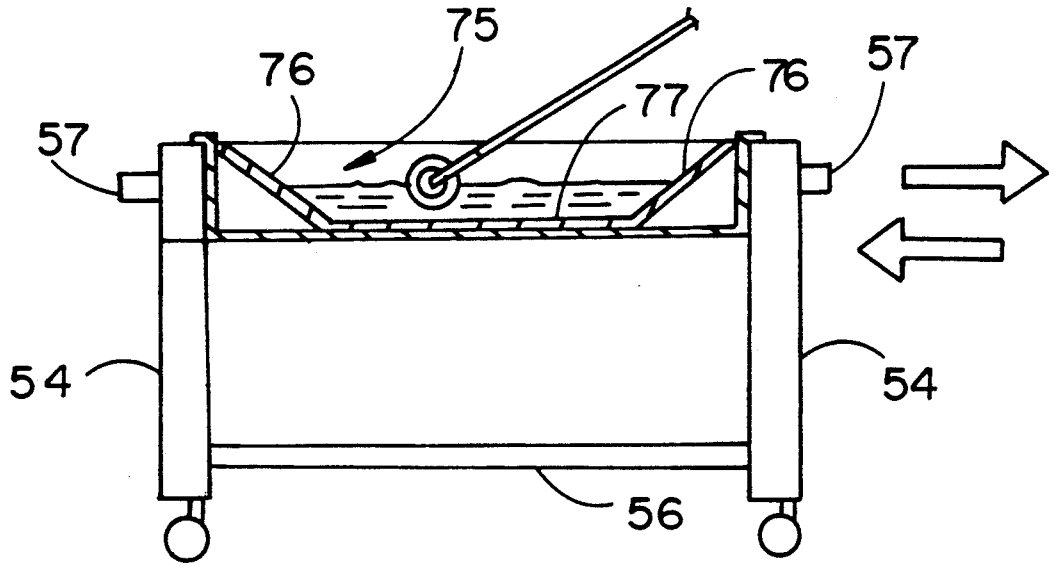
FIG. 22B is a cross sectional view of an alternate embodiment of the paint pan.

Referring to FIG. 22B, in an alternate embodiment, the paint pan 75 has two shallower ends 76 and a deeper center portion 77. Thus, the painter may use the paint roller efficiently with the paint pan 75 when the painter is positioned at either end of the paint pan 75. It is unnecessary for the painter either to move around the work station 10' or to turn the work station 10' so that the paint roller may be rolled on the shallower end 76 to remove excess paint. The work station may be provided with a handle 57 at both opposite sides so that the work station may be easily moved by the painter when using the paint pan 75 with two shallower ends 76.

The tray 53 also may have a removable compartment 64 which may be disposed adjacent to the painter's pan 61. This compartment 64 may be used for painting accessories such as brushes, sandpaper, etc. and also for personal items of the painter.

Figure 26:
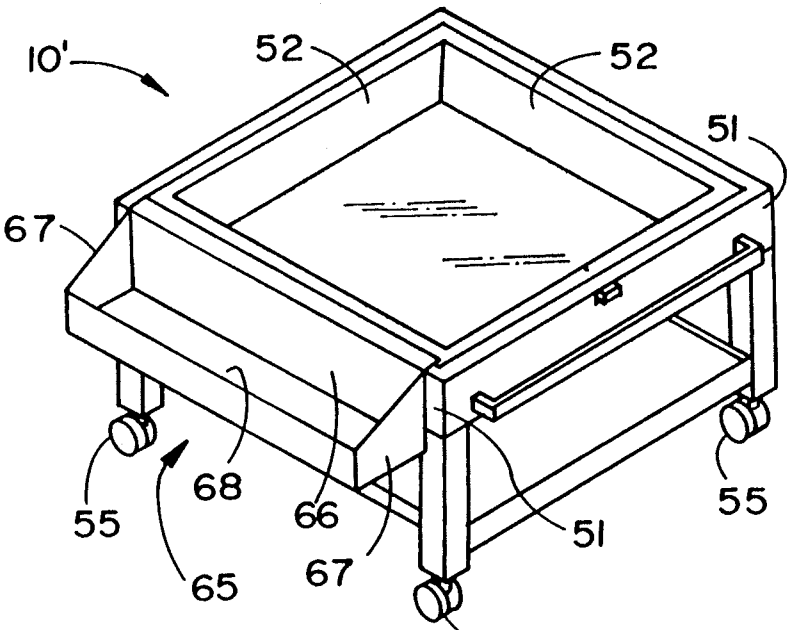
FIG. 26 is a perspective view of the embodiment of FIG. 15 showing a removable receptacle attached to the frame of the work station.

The mobile work station 10' may also be provided with one or more removable receptacles 65 with means for attachment to the work station 10'. The means for attachment may be posts extending upwardly from the frame 50 which engage openings in the receptacle 65. Other means known to persons skilled in the art may also be used. As shown in FIG. 26 the receptacle 65 has a back 66, two sides 67, and at least one shelf 68. The receptacle 65 may be used to store the painter's tools, brushes, and similar items and may also be used for storage of the painter's personal articles.

Accordingly, it will be appreciated that the present invention readily achieves its objectives. The work station is mobile; provides a convenient means for holding paint, accessory equipment, tools and personal items; is relatively lightweight; and is easily transported and stored. It will be appreciated that, although use by painters has been identified, other workmen and homeowners will find the mobile work station of the present invention of great utility for general movement of equipment, tools and other materials. Also, it will be appreciated that the mobile work station may be rectangular or have other configurations adaptable to specific purposes; and, although the drawings show a work station having four legs, other configurations may be stably supported with other than four legs.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A mobile work station for a painter, wherein the mobile work station is relatively lightweight and collapsible to facilitate transport and storage, comprising a frame having side walls to form an open well substantially in the center thereof; a tray having side walls and a bottom; means to mount the tray in the open well in the frame, whereby a paint roller, paint pan, brushes and the like may be disposed in the tray and moved about by the painter on the job; a plurality of legs, each leg having a first end and a second end, the first end of each leg being mounted on the frame and being capable of being pivoted, such that each leg has a first position in which the leg is adjacent to the frame, and such that each leg has a second position in which the leg depends downwardly to support the frame; means for securing each leg in both the first and second positions, respectively; and a cover removably attached to the frame; wherein when the cover is attached to the frame, the cover encloses the open well in the frame such that the tray and the contents of the tray are contained therein, and such that the mobile work station may be conveniently transported and stored; wherein when the legs are in the second downwardly-depending position to support the frame, the cover may be detached from the frame and may be disposed between the legs, and wherein means are provided for removably attaching the cover to the legs, such that the cover further supports the legs in the downwardly-depending position, providing additional structural integrity for the mobile work station, and further serving as a shelf thereon.

2. The mobile work station of claim 1, wherein the frame is substantially rectangular and has four side walls.

3. The mobile work station of claim 1, wherein the work station has four legs.

4. The mobile work station of claim 3, wherein casters are carried by the second end of each leg, thereby facilitating the movement of the mobile work station on the job.

5. The mobile work station of claim 3, further including a handle carried by the frame to facilitate movement of the mobile work station by the painter.

6. The mobile work station of claim 5, wherein a paint pan is disposed in the tray for use by the painter with the paint roller, the paint pan having a shallower end and a deeper end, and the tray being configured such that the shallower end of the paint pan will always be nearer to the handle on the frame and adjacent to the painter, and such that the deeper end of the pan will be further removed from the painter.

7. The mobile work station of claim 3, wherein at least one compartment is formed in the tray for storage of painting accessories.

8. The work station of claim 3, further having a removable receptacle attached thereto, the removable receptacle comprising a back, two sides, at least one shelf mounted on the back; and means for removably attaching the receptacle to the mobile work station, such that painter's tools and personal items may be placed in the receptacle.

9. The work station of claim 1, wherein the frame has a top portion and side walls of the tray each have a respective upper edge, each upper edge having a flange thereon, and wherein the flanges extend outwardly such that the flanges may be disposed on the top portion of the frame when the tray is mounted in the open well in the frame.

10. A mobile work station for a painter, wherein the mobile work station is relatively lightweight and foldable to facilitate transport and storage, comprising a substantially rectangular frame having four side walls, the side walls forming an open well in the center thereof; a tray having side walls and a bottom; means to mount the tray in the open well in the frame, whereby a paint roller, paint pan, brushes and the like may be disposed in the tray and moved about by the painter on the job; four legs, each leg having a first end and a second end, the first end being mounted on the frame and being capable of being pivoted such that each leg has a first position in which the leg is adjacent to the frame and such that each leg has a second position in which the leg depends downwardly to support the frame; means for securing each leg in both the first and second positions, respectively, casters carried by the second end of each leg, thereby facilitating the movement of the mobile work station on the job; and a cover removably attached to the frame; wherein when the cover is attached to the frame, the cover encloses the open well in the frame, such that the tray and the contents of the tray are contained therein during storage and transport of the mobile work station; and wherein when the cover is detached from the frame, the cover may be disposed between the legs when the legs are in the second-downwardly depending position; and means for removably attaching the cover to the legs, such that the cover further supports the legs in their downwardly-depending position and provides additional structural integrity for the mobile work station, and wherein the cover further serves as a shelf on the mobile work station.

11. A mobile work station for a painter, wherein the mobile work station is compact, lightweight and readily portable, and wherein the mobile work station may be quickly set up on the job and, thereafter, may be quickly folded up for convenient storage, comprising a frame having a plurality of legs carried thereon, the legs having respective wheel means thereon, means for folding the legs into a compact storage position on the frame, means for extending the legs into a downwardly-depending position relative to the frame, the frame having an open well formed thereon, means for supporting a removable paint pan on the frame during use of the mobile work station, a removable cover for the open well in the frame when the mobile work station is not in use; means for removably securing the cover to the frame, and means for removably securing the cover to the plurality of legs and wherein, when the mobile work station is being used, the cover may be detached from the frame and may be disposed between the downwardly-depending legs and removably secured thereto, thereby providing additional structural integrity for the mobile work station during use thereof, and thereby providing a shelf to support a relatively large paint can received down through the open well in the frame when the paint pan is removed from the frame.

12. A mobile work station for a painter, wherein the mobile work station is compact, lightweight and readily portable, and wherein the mobile work station may be quickly set up on the job and, thereafter, may be quickly folded up for convenient storage, comprising a frame having a plurality of legs carried thereon, the legs having respective wheel means thereon, means for folding the legs into a compact storage position on the frame, means for extending the legs into a downwardly-depending position relative to the frame, the frame having an open well formed thereon, means for supporting a removable paint pan on the frame during use of the mobile work station, a removable cover for the open well in the frame when the mobile work station is not in use; and wherein, when the mobile work station is being used, the cover may be disposed between the downwardly-depending legs and removably secured thereto, thereby providing additional structural integrity for the mobile work station during use thereof, and thereby providing a shelf to support a relatively large paint can received down through the open well in the frame when the paint pan is removed from the frame; wherein the means to support the paint pan on the frame comprises a tray removably received in the open wall in the frame, the tray having a plurality of laterally-extending flanges supported on the frame, and the tray being segmented to provide a first recess for the paint pan and at least a second recess for painting accessories or for the painter's personal items.

13. The mobile work station of claim 14, further including a handle on the frame to facilitate movement of the mobile work station by the painter.

14. The mobile work station of claim 15, wherein the paint pan has a shallow end and further has a deeper end, respectively, and wherein the first recess in the tray is configured to assure that the shallow end of the paint pan is disposed towards the handle, and that the deeper end of the paint pan is disposed away from the handle, when the paint pan is in the first recess in the tray.

15. A mobile work station for a painter, wherein the mobile work station is compact, lightweight and readily portable, and wherein the mobile work station may be quickly set up on the job and, thereafter, may be quickly folded up for convenient storage, comprising a frame having a plurality of legs carried thereon, means for folding the legs into a compact storage position on the frame, means for extending the legs into a downwardly-depending position relative to the frame, the frame having an open well formed thereon, the open well having a top portion, a tray for supporting a removable paint pan on the frame during use of the mobile work station, the tray being received in the top portion of the open well in the frame, the tray being segmented to provide a first recess for the paint pan and at least a second recess for painting accessories or for the painter's personal items, a handle on the frame to facilitate movement of the mobile work station by the painter, the paint pan having a shallow end and a deeper end, respectively, and wherein the first recess in the tray is configured to assure that the shallow end of the paint pan is disposed towards the handle, and that the deeper end of the paint pan is disposed away from the handle, when the paint pan is in the first recess in the tray, a removable cover for the open well in the frame when the mobile work station is not in use; means for removably securing the cover to the frame, and means for removably securing the cover to the plurality of legs and wherein, when the mobile work station is being used, the cover may be disposed between the downwardly-depending legs and removably secured thereto, thereby providing additional structural integrity for the mobile work station during use thereof, and further serving as a shelf thereon.

16. In a mobile work station for a painter, the combination of a frame including means for moving the frame about the job, the frame having a plurality of legs carried thereon, means for folding the legs into a compact storage position against the frame, means for extending the legs into a downwardly-depending position relative to the frame, the frame having an open well formed thereon, the open well having a top portion, a tray removably received on the top portion of the frame, such that the tray substantially covers the open well on the frame, a cover removably secured to the frame over the tray, the cover being removed during use of the mobile work station, a handle means on the frame, thereby facilitating movement of the mobile work station by the painter on the job, a paint pan and means for supporting the pan on the tray during use of the mobile work station, the paint pan having a shallow end and a deep end, respectively, and means for orienting the paint pan on the tray such that the shallow end of the paint pan is towards the handle on the frame during use of the mobile work station, a removable cover for the open well in the frame when the mobile work station is not in use; means for removably securing the cover to the frame, and means for removably securing the cover to the plurality of legs and wherein, when the mobile work station is being used, the cover may be disposed between the downwardly-depending legs and removably secured thereto, thereby providing additional structural integrity for the mobile work station during use thereof, and further serving as a shelf thereon.

17. In a mobile work station for a painter, the combination of a frame, means on a frame for supporting a paint container, painting accessories or the painter's personal items, a plurality of legs carried by the frame, each leg having a distal end, each distal end having wheeled means attached thereto, means for folding the legs into a compact storage position against the frame, means for extending the legs into a downwardly depending position relative to the frame during use of the mobile work station, the frame having an open well formed centrally therein between the legs, a removable cover for the open well on the frame, means for removably securing the cover to the frame, and means for removably securing the cover to the plurality of legs such that the cover may be disposed between the extended legs and removably secured therebetween, thereby providing additional structural integrity for the mobile work station and providing a shelf during use of the mobile work station.

18. A mobile work station for a painter, wherein the mobile work station is compact, lightweight and readily portable, and wherein the mobile work station may be quickly set up on the job and, thereafter, may be quickly folded up for convenient storage, comprising a frame having a plurality of legs carried thereon, each leg having a distal end, each distal end having wheeled means attached thereto, means for folding the legs into a compact storage position on the frame, means for extending the legs into a downwardly-depending position relative to the frame, the frame having an open well formed thereon, the open well having a top portion, a tray for supporting a removable paint pan on the frame during use of the mobile work station, the tray being received in the top portion of the open well in the frame, the tray being segmented to provide a first recess for the paint pan and at least a second recess for painting accessories or for the painter's personal items, a handle on the frame to facilitate movement of the mobile work station by the painter, the paint pan having a shallow end and a deeper end, respectively and wherein the first recess in the tray is configured to assure that the shallow end of the paint pan is disposed towards the handle, and that the deeper end of the paint pan is disposed away from the handle, when the paint pan is in the first recess in the tray; and a cover removably secured to the frame over the tray means for removably securing the cover to the frame, and means for removably securing the cover to the plurality of legs, the cover being removed during use of the mobile work station and the cover being disposed between the downwardly-depending legs and removably secured thereto, thereby providing additional structural integrity for the mobile work station during use thereof, and further serving as a shelf thereon.

19. A mobile work station for a painter, wherein the painter uses a roller paint applicator and a paint pan, the paint pan having a shallow end and a deep end, the work station comprising a frame and tray means to receive the paint pan; a plurality of pivotable legs, such that the legs are folded adjacent to the frame in a collapsed position, and such that the legs depend downwardly from the frame in an erected position; a removable cover to cover the tray means when the mobile work station is not in use; means for removably securing the cover to the frame, and means for removably securing the cover to the plurality of legs and wherein, when the mobile work station is being used, the cover may be disposed between the downwardly-depending legs and removably secured thereto, thereby providing additional structural integrity for the mobile work station during use thereof and further serving as a shelf thereon; the mobile work station being substantially rectangular and in a horizontal plane, when erected, and including four corners, and the plurality of pivotable legs comprising four legs which depend vertically downwardly from the frame substantially form the respective four corners thereof, such that the legs are perpendicular to the plane of the mobile work station, so that the paint pan is at a convenient elevated height above the floor, and so that the painter may apply paint to the paint applicator without repeatedly deep bending, thereby reducing painter fatigue; and the mobile work station thereby having improved stability for moving the mobile work station around the job site, the legs having end portions provided with caster means, such that the mobile work station may be conveniently moved around the job site; a handle attached to the mobile work station, the handle being disposed between the painter and the mobile work station, and further being disposed adjacent to the shallow end of the paint pan and remote from the deep end of the paint pan, such that the painter may grasp the handle for pushing or pulling the mobile work station around the job site; whereby the mobile work station is in front of the painter and spaced apart laterally from the work surface, such that the handle is adjacent to the painter for the painter's convenient grasp, and such that the elevated paint pan on the mobile work station is oriented substantially parallel to the work surface and longitudinally relative to the painter with the shallow end of the paint pan near the painter and the deep end of the paint pan away from the painter, wherein the painter may turn approximately 90° from the mobile work station to the work surface; such that spilling of paint is prevented and without requiring the lifting of the paint pan by the painter; and without requiring unnecessary movement by the painter around the job site or around the mobile work station, thereby enhancing the speed, quality and efficiency of the work being performed by the painter while simultaneously reducing painter fatigue on the job.

20. A module work station for a painter, wherein the mobile work station may be carried to a job site and quickly erected for use and, thereafter, quickly folded into a compact article for convenient storage, comprising a frame means having an open tray means therein, such that in the erected position of the mobile work station, a paint pan may be disposed with the tray means means for removably securing the cover to the frame, and means for removably securing the cover to the plurality of legs carried by the frame means a plurality of pivotable legs folded therein in a storage position of the mobile work station, the plurality of legs being a cover for the open tray means, and depending downwardly from the frame means in the erected position of the mobile work station the cover being removable and re-attachable between the leg means, thereby providing additional structural integrity for the mobile work station in its erected position.

* * * * *